US006569064B1

(12) United States Patent
Loane

(10) Patent No.: US 6,569,064 B1
(45) Date of Patent: May 27, 2003

(54) SKI EXERCISING APPARATUS

(76) Inventor: R. Joel Loane, P.O. Box 592, Park City, UT (US) 84060

( * ) Notice: Subject to any disclaimer, the term of this patent is extended or adjusted under 35 U.S.C. 154(b) by 0 days.

(21) Appl. No.: 09/533,614

(22) Filed: Mar. 22, 2000

(51) Int. Cl.[7] ..... A63B 69/18
(52) U.S. Cl. ..... 482/71; 482/146
(58) Field of Search ..... 482/51, 52, 53, 482/70, 71, 79, 80, 148, 146

(56) References Cited

U.S. PATENT DOCUMENTS

| | | | | | |
|---|---|---|---|---|---|
| 3,547,434 | A | * | 12/1970 | Ossenkop | 482/71 |
| 3,704,885 | A | * | 12/1972 | Raciunas | 482/71 |
| 3,731,919 | A | * | 5/1973 | Schurch | 482/71 |
| 5,020,793 | A | * | 6/1991 | Loane | 482/71 |
| 5,147,257 | A | * | 9/1992 | Loane | 482/71 |

* cited by examiner

*Primary Examiner*—Stephen R. Crow
(74) *Attorney, Agent, or Firm*—Donald R. Boys; Central Coast Patent Agency, Inc.

(57) ABSTRACT

A ski exercising machine has a set of at least two parallel rails joined to cross members at the ends, the cross members providing support on a horizontal support surface, and joined to a central frame structure extending from the horizontal surface near the center to the rails, the rails extending from each cross member at each end upward at an acute angle with the horizontal rising to a maximum height in the center. A wheeled carriage rides on the rails, and there is at least one articulated footpad mounted to the wheeled carriage. A first power band having two ends, anchored at both ends by a clamp to a bottom surface of the frame structure beneath the wheeled carriage, passes over first rollers fixed to the cross members, and is anchored to the wheeled carriage, such that the power band is extended and exerts a restraining force toward the center of the machine as the wheeled carriage translates on the rails to either side of center. The set of rails is characterized in that the rails have a central arcuate portion and straight portions extending from each cross member to the central arcuate portion. In preferred embodiments there may be two articulated footpads, and footpads of different sorts are provided as modular assemblies for quick changing. Various rail structures are taught, including structures having keeper apparatus for the wheeled carriage.

38 Claims, 21 Drawing Sheets

SKI EXERCISING APPARATUS

CROSS-REFERENCE TO RELATED DOCUMENTS

This application is related in part to U.S. Pat. No. 5,147,257 issued on Sep. 15, 1992 and filed on Sep. 4, 1990, which is a divisional of U.S. Pat. No. 4,953,853 issued on Sep. 4, 1990 and filed on Apr. 6, 1988, which is a continuation-in-part of U.S. Pat. No. 4,743,014 issued on May 10, 1998 and filed on Jul. 30, 1987. This application is also related to U.S. Pat. No. 5,020,793 issued on Jun. 4, 1991 filed on Oct. 24, 1989, which is also a continuation-in-part of U.S. Pat. No. 4,743,014. The related patents are included herein in their entirety by reference.

FIELD OF THE INVENTION

This invention relates to exercising apparatus for a user to simulate the motions, exertions and techniques involved in skiing, thereby increasing the user's strength and skill, and more particularly to improvements in such apparatus.

BACKGROUND OF THE INVENTION

Apparatus for use by skiers on which they may simulate the motions, exertions and techniques required in skiing has been built and sold for several years. In particular U.S. Pat. No. 3,524,641 was issued to Robert J. Ossenkop on Aug. 18, 1970, for a device comprising a movable carriage on a set of rails. The carriage of that device is constrained in its movement on the rails by flexible members attached to both the carriage and to transverse members between the rails near each end of the set of rails, and a user can move the carriage from side to side on the rails to simulate the Wedeln or "parallel" technique of skiing.

U.S. Pat. No. 3,547,434 was issued to the same inventor on Dec. 15, 1970. This later patent is for a device similar to the first device, but comprising a number of improvements, such as movable footrests on the carriage whereby a user may simulate turning and edging techniques in addition to parallel skiing; and, in some embodiments may also move the feet relative to one another.

The inventions referenced above each include a safety strap attached to a transverse member between the parallel rails and to the carriage on the rails in addition to the flexible member by which the carriage is constrained to travel on the rails. The purpose of the safety strap is to provide for a situation in which the aforementioned flexible member might rupture on one side of the carriage, providing a sudden force urging the carriage to the side where the flexible member remains unruptured, which sudden force could dislodge a user and perhaps cause serious injury. The safety strap in such instance provides a restoring force toward the center tending to lessen the amplitude of carriage displacement that might otherwise occur.

In U.S. Pat. No. 4,743,014, to which this case is related, and by the same inventor, an exerciser is disclosed having a pair of spaced-apart rails, a platform for riding on the rails, a first resilient element providing a first restoring force on the platform, and a second resilient element providing a second restoring force on the platform. The second resilient element has an adjustment element contacting the second resilient element in at least three points.

In the latter exerciser, the rails are held in a spaced-apart relationship by a brace element in the center, which is fastened to the rails by screw-type fasteners, and by transverse elements fastened at the ends of the rails. The transverse elements at the ends are tubular in form, and the rails pass through openings in the tubular transverse elements, fastening to a bracket internal to each tubular transverse element. This joining arrangement is illustrated by FIGS. 1A and 1B of the referenced patent. As shown in these figures rails 301 and 303 pass through holes 305 and 307 respectively into tubular transverse element 309. Inside, the rails are fastened to a bracket 311 by screw fasteners 313 and 315. Rubber-like end caps 317 and 319 close the ends of the tubular transverse element after assembly and act as non-skid pads in contact with the floor in operation. The end caps are of molded rubber-like material, and disk-like pieces carrying designs and lettering are added for identification and aesthetic effect. This particular method of joining and spacing the rails has not proved entirely satisfactory in terms of cost and ease of assembly, and in terms of strength and rigidity of assembly, and the multiple-piece construction of the end caps has also proved to be relatively expensive.

Although related U.S. patents issued to the inventor address the above problem and other problems related to construction and function of various components of the parent ski exerciser, there are. still non-obvious improvements desired in several areas related to construction or assembly techniques, profile, materials, and longevity of the apparatus. For example, in U.S. Pat. No. 5,147,257 (hereinafter '257), in FIGS. 5A and 5B, a ski exerciser is illustrated both in an elevation view (FIG. 5A), and in a plan view (overhead FIG. 5B). Arcuate rails 15 comprise tubing structures having a continuous arc or bow over their entire length.

It has been discovered through empirical method that an even better action may be simulated with rails shaped somewhat differently than in the prior art. Firstly, the tubing material used in rails 15 can be changed to exhibit even more strength than previously. Secondly, the inventor has discovered that other shapes for the rails than fully arcuate provide better skiing feel than the fully arcuate rails in the referenced prior patents.

FIG. 5A in '257 illustrates roller assemblies housing rollers such as rollers 25 and 27 which are identical in size and construction with other illustrated rollers which make rolling contact with resilient members 23 and 59. The diameter of the aforementioned rollers is disclosed as approximately 1 inch, and the rollers are generally cylindrical. It has been discovered that larger rollers, also crowned have a beneficial effect in smoother power band operation. The crowned rollers keep the belts better centered on the rollers.

The present inventor has also determined that improvements may be made in the positioning of wheels for the wheeled carriage, and in the form of the rails and how the wheels interface to the rails.

What is clearly needed is a modularly enhanced ski-excising device that provides further distinct advantages for the expanding field of users. Such a device could be manufactured with fewer assembly parts, retain a lightweight characteristic, provide additional stability and rigidity, and require less work for a user to assemble and operate, as well as providing for a more realistic workout.

SUMMARY OF THE INVENTION

In a preferred embodiment of the present invention a ski exercising machine is provided, comprising a set of at least two parallel rails joined to cross members at the ends, the cross members providing support on a horizontal support surface, and joined to a central frame structure extending from the horizontal surface near the center to the rails, the rails extending from each cross member at each end upward at an acute angle with the horizontal rising to a maximum height in the center; a wheeled carriage riding on the rails; at least one articulated footpad mounted to the wheeled carriage; and a first power band having two ends, anchored at both ends by a clamp to a bottom surface of the frame structure beneath the wheeled carriage, passing over first rollers fixed to the cross members, and anchored to the wheeled carriage, such that the power band is extended and exerts a restraining force toward the center of the machine as the wheeled carriage translates on the rails to either side of center. The set of rails is characterized in that the rails have a central arcuate portion and straight portions extending from each cross member to the central arcuate portion.

In some embodiments the cross members are spaced apart more than 48 inches, and the arcuate portion extends for at least one third of the overall length. Also in some embodiments there are two articulated footpads mounted to the wheeled carriage, each footpad having a contact surface for a user's foot and pivoted to rotate about an axis orthogonal to the direction of the rails, the axis below the level of the contact surface. In some embodiments footpads mount to an upper tray assembly adapted to removably fasten to the wheeled carriage, forming thereby a quick-change module.

In a preferred embodiment the first power band is clamped to an undersurface of the wheeled carriage at two positions, one each at each end of the wheeled carriage, such that the first power band lies flat along the width of the wheeled carriage under the wheeled carriage. Also in a preferred embodiment the cross members at the ends are welded to the rails and the rails are welded to the central frame structure, and the bottom surface of the central frame structure is joined by welding to the cross members on each end by power band guides, the power band guides, the cross members, and the bottom surface of the central frame structure all lying parallel to and adjacent the horizontal surface. The first rollers fixed to the cross members are positioned such that the first power band anchored at the ends to the clamp at the bottom surface of the frame structure lies in the power band guides to each side of the central structure, passing under and over the rollers to the wheeled carriage, the power band guides acting as protective members preventing the first power band from contacting the horizontal support surface.

In most embodiments there is a second power band within the first power band, the second power band having ends both fastened at the clamp holding the ends of the first power band above the ends of the first power band, the second power band extending to second rollers rotatably mounted to a structure welded to the bottom surface of the central frame structure to each side of center, the second power band passing under and over the second rollers back toward center, and over a third roller rotatably mounted under the wheeled carriage. The third roller is mounted spaced apart from the first power band clamped to the undersurface of the wheeled carriage by about twice the thickness of the power band, such that the second power band passing over the roller contacts both the roller and the first power band.

In some embodiments the wheeled carriage has weight-bearing wheels positioned to ride on upper surfaces of the rails and keeper wheels opposite individual ones of the weight-bearing wheels, the keeper wheels contacting undersurfaces of the rails, such that the wheeled carriage so equipped is positively retained on the rails. Also in some embodiments two articulated footpad assemblies each comprises a foot contact area having front and back upward extensions pivotally joined to frame elements above the footpad area, forming swing-cradle footpads. In a special embodiment the two swing-cradle footpad assemblies each mount slidably by an interface to the upper tray, the interface including a lock-unlock mechanism whereby the footpad assemblies may be unlocked, adjusted in position on the upper tray, and relocked, so the center distance between the footpads may be readily adjusted.

The two articulated footpads may be joined by at least one link, such that the footpads are constrained to rotate together about their respective axes, and the footpads have a home position wherein the footpads are each canted inward, the degree of cant determined by the length of the link. In some cases the link is adjustable, such that the degree of cant at the home position may be adjusted.

In yet another embodiment there is a snowboard footpad simulating a snowboard mounted on an interchangeable upper tray assembly, the snowboard footpad being rotatable about an axis orthogonal to the direction of the rails, and having a length in the direction of the axis significantly more than the width of the wheeled carriage riding on the rails, and extending beyond the wheeled carriage on both sides. The snowboard footpad has a surface for a user's feet, and the axis for pivoting is above the level of the surface for the user's feet.

In several embodiments the rails are extruded each having a groove in an upward facing surface, and the wheeled carriage includes wheels that ride within the groove in the upward-facing surface. In some other embodiments there is also a groove in a downward-facing surface of each rail, and the wheeled carriage includes wheels engaging both the upward-facing and downward-facing grooves. In yet other embodiments each rail has a "C" cross-section comprising internally an upper, downward-facing track and a lower, upward-facing track, and wherein the wheeled carriage has two or more wheels guiding on the upper track and two or more wheels guiding on the lower track.

In yet another embodiment of the invention a ski exercising machine is provided, comprising a set of at least two parallel rails joined to cross members at the ends, the cross members providing support on a horizontal support surface, and joined to a central frame structure extending from the horizontal surface near the center to the rails, the rails extending from each cross member at each end upward at an acute angle with the horizontal rising to a maximum height in the center; a wheeled carriage riding on the rails; at least one articulated footpad mounted to the wheeled carriage; and a set of three power bands each anchored at both ends by a clamp to a bottom surface of the frame structure beneath the wheeled carriage, passing over separate roller sets, with one or more of the power bands anchored to the wheeled carriage and one or more passing over a roller anchored to the wheeled carriage.

In the many embodiments of the present invention significant improvements are provided over ski-exercise machines known in the art, the improvements making such equipment more durable, less expensive to build, and providing even more realistic operation.

BRIEF DESCRIPTION OF THE DRAWING FIGURES

DESCRIPTION OF THE PREFERRED EMBODIMENTS

It is the object of the present invention to provide a ski exercising apparatus similar to that apparatus covered in cross-related documents above, that is modularly enhanced such that, among other improvements, changing applications on the apparatus may be performed with minimal effort. It is also an object of the present invention that the above apparatus be generally and innovatively improved to accomplish a goal of maintaining a lightweight while increasing strength and durability of the apparatus. A further object of the present invention is to provide such an apparatus as described above having a lower profile, improved safety features, and having fewer assembly parts with which to contend. Such a ski-exercising apparatus is described in enabling detail below.

Figure 1A:
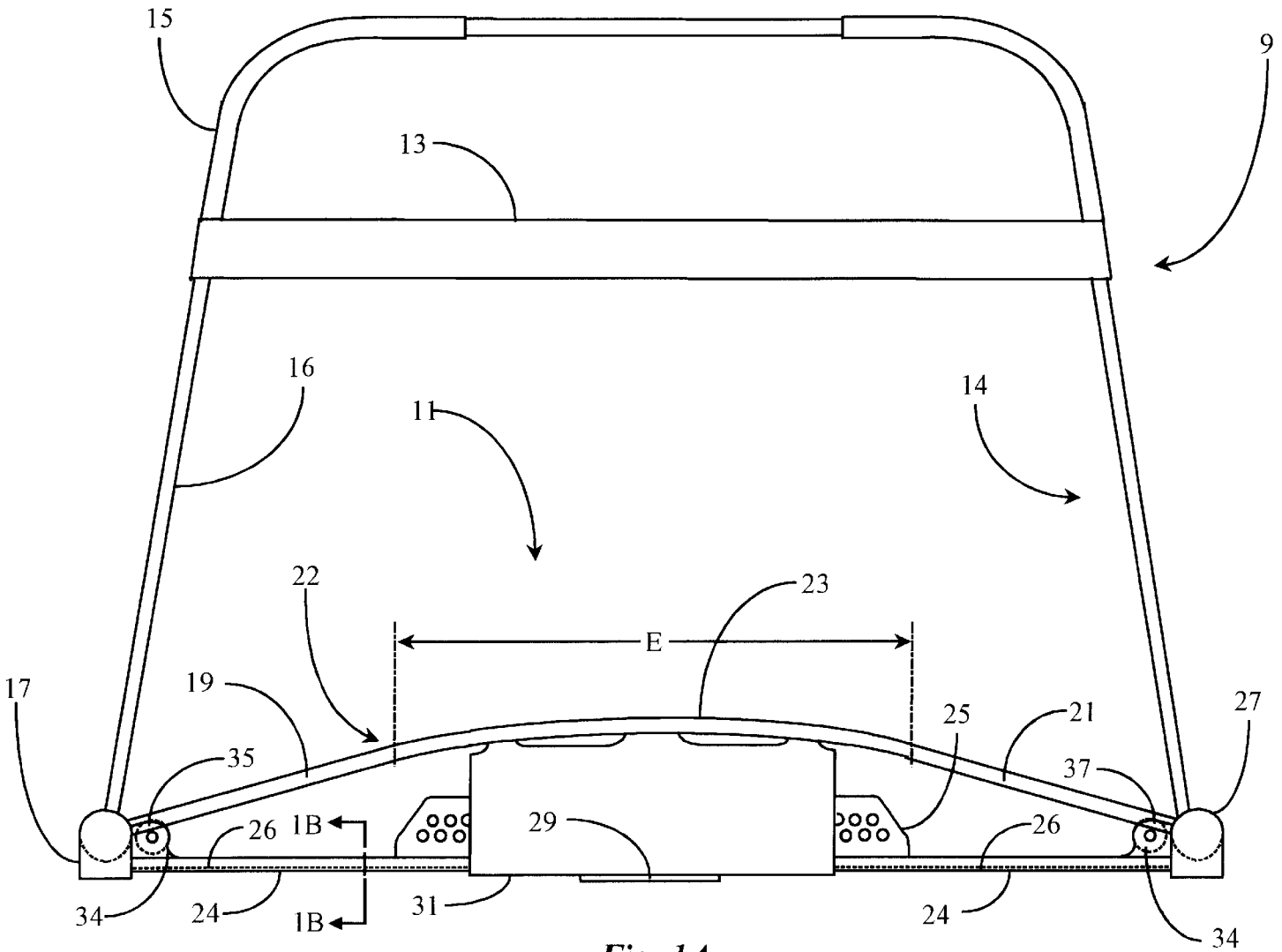
FIG. 1A is an elevation view of a frame structure of a ski-exercising device according to an embodiment of the present invention.
Figure 1B:
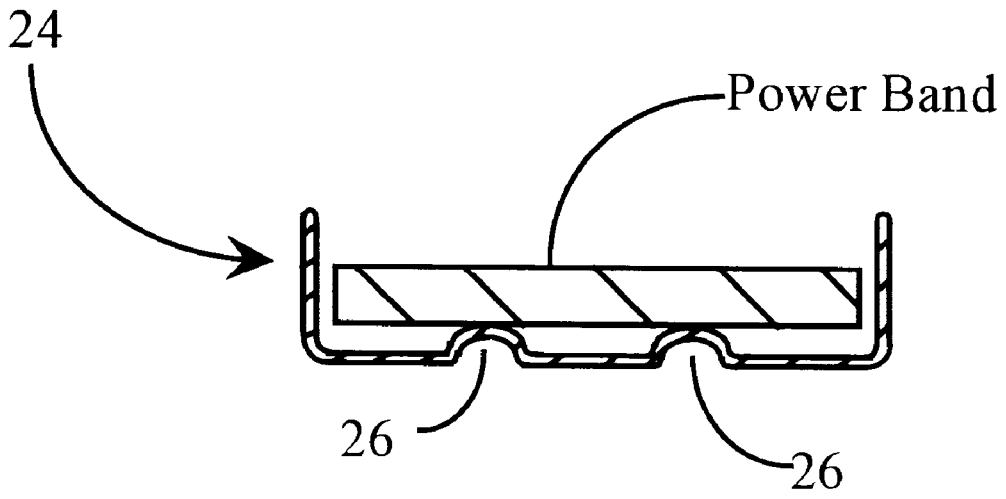
FIG. 1B is a cross section taken along line 1B—1B of FIG. 1A.

FIG. 1 is an elevation view of a frame structure 11 of a ski-exercising apparatus 9 according to an embodiment of the present invention. Apparatus 9 is provided having a generally similar frame-architecture to previously described exercisers disclosed in related U.S. patents issued to the inventor except for novel improvements that are described below. For the purpose of clarification, only a frame structure 11 of apparatus 9 is described in this embodiment. Additional components not seen here are described later in this specification.

In a preferred embodiment of the present invention, frame structure 11 comprises a pair of semi-arcuate rails 22 that are held parallel to each other and are affixed at either end of each rail to a pair of transverse end-members 27. As this is an elevation view, only one of the pair of rails is seen. The spacing and parallelism is seen in plan view FIG. 2. This arrangement of rails 22 affixed to members 27 forms the basic frame-structure 11 of apparatus 9. One notable difference between semi-arcuate rails 22 and the fully arcuate rails disclosed in related patents such as rails 15 of U.S. Pat. No. 5,147,257, is as the respective descriptors imply. That is, as in FIG. 1A, rails 22 are arced only in their center portions 23 and illustrated by a dimensional notation E. The dimension lines associated with portion 23 mark the locations where the arced portion of each rail 22 ends at positions sharing an equal distance from a theoretical vertical center of rails 22.

The total distance E in a preferred embodiment is approximately 26 inches, defined as that portion of each rail 22 that is arced. The stated arc of arcuate portion 23 has a radius of approximately 76 inches although a slightly higher or lower radius may be used in other embodiments. Non-arcuate portions of rails 22 are witnessed by element numbers 19 and 21 on the left and right side of apparatus 9 as seen in this view. The lengths (taken horizontally) for rail portions 19 and 21 are approximately 15 inches respectively. Rail portions 19 and 21 are substantially straight from their junctures with arcuate portion 23. The dimensions cited above are intended to be approximate only. When including an approximate 2.36-inch (6 cm) diameter for each transverse member 27, the approximate overall length of frame structure 11 is about 61 inches. Semi-arcuate rails 22 may be manufactured from heavy-gauge steel tubing as described in U.S. Pat. No. 5,147,257. In one embodiment, rails 22 may be made of extruded steel or aluminum bars rather than steel tubing, and rails may be solid or hollow in different embodiments. Such rails may often also be formed in a forming die to manufacture tracks.

Solid aluminum bars may in some circumstances offer more strength than steel tubing in terms of flexing or bending while retaining a lightweight characteristic. Moreover, such bars may be extruded to comply with varied shapes as may be desired, and may also be produced in hollow configurations. In this particular embodiment, rails 22 are solid and round in cross-section (rods). The semi-arcuate design and solid structure of rails 22 adds considerable strength and durability causing less flex when rails are in use. It is not specifically required that rails 22 be of round cross-section in order to practice the present invention. The inventor intends merely that keeping a round cross-section consistent with previously used steel tubing is consistent with conventional wheels used on wheeled-carriage assemblies such as carriage 11 described in U.S. Pat. No. 5,147,257.

In another embodiment, rails 22 may be extruded and then die-formed to a shape that may conform to an alternate wheel design. Such an embodiment is described later in this specification. The size of rails 22 is approximately 2.5 cm. (1-inch) in diameter as is consistent with previous related embodiments. However, this should not be construed as a limitation in diameter but only a preference in balancing durability with lightweight characteristics. Other diameters for rails 22 are plausible. Transverse members used in an embodiment where rails are aluminum will also be made of aluminum tubing to facilitate welding. However, where rails are steel tubing or rods, transverse members will typically be manufactured from steel tubing. A durable polymer coating is applied to all visible parts and surfaces of apparatus 9 in order to provide a resistance to corrosion and for appearance purposes.

The straight portions of rails 22 to each side of arcuate portion 23 provide a carriage movement in operation that more nearly simulates an actual skiing-experience, as has been testified to by users of the apparatus.

In a preferred embodiment of the present invention, rails 22 are welded to transverse members 27 to form a one-piece truss-frame insuring long life and durability along with ease of assembly of associated elements. However, many fastening methods are known and practiced in the art and could also be used to affix rails 22 to transverse members 27. The frame structure 11 of apparatus 9 also comprises belt guides 24 located in a substantially centered and parallel position in-between rails 22 and welded, at opposite ends, to transverse members 27 and to a support frame member 31 supporting the rails in the centered arcuate portion. Belt guides 24 allow a power band such as element 23 of FIG. 5A of '257 to be separated from the floor or carpet during operation, thus contributing to longer life and sparing wear and discoloration of the floor or carpet. A belt guide of the type disclosed herein has not been previously taught. A pair of raised ribs 26 running the length of belt guides 24 on each side of member 31 are provided and adapted to allow a power band to avoid contact with the bottom of belt guide 24 further reducing wear and noise.

Support member 31 is provided for the purpose of lending additional support to the frame structure 11 of apparatus 9, and for housing mechanisms associated with operation of the exerciser. A structure of the same name is illustrated in FIG. 5A (element 55) of '257 and member 31 is analogous to that member, but improved in function. For example, support member 31 as illustrated herein, is longer in length than the aforementioned member 55 thereby supporting more area of rails 22. Support member 31 may be provided as one piece or as a plurality of components welded together such that one single piece is formed. Support member 31 is made wider than previously disclosed support members such that it may be welded in some embodiments to the outside edges of rails 22 instead of having rail-inserted tabs as described with member 55 of FIG. 5A in '257. Welding support member 31 to the outside edges of rails 22 increases the strength and durability of frame structure 11, and allows further improvements described more fully below.

Support member 31 is further welded to belt guides 24 as previously described, effectively adding these components to frame structure 11 so as to form a single contiguous and integral frame, thereby lending strength, durability, and eliminating assembly requirements. Also welded to support member 31 is a tension-adjustment structure 25. Structure 25 in this embodiment is a u-shaped structure welded to the bottom of member 31 such that two vertical planes are presented, one on each side of the power band path, with holes for positioning rollers for adjustment of power band tension. The length of structure 25 is such that it extends beyond each side of member 31, as shown, and guides 24 weld to structure 25. In this manner structure 25 becomes a part of the overall welded structure 11 adding durable strength to the structure as a whole. Additionally, two roller brackets 34 are illustrated, housing rollers 35 in this embodiment, and these are also welded to transverse members 27 and to belt guide 24, and are part of frame structure 11 of apparatus 9. Much assembly is avoided and much durability and strength is added by providing a multi-component but single piece welded frame architecture for apparatus 9 as will readily be appreciated by one with skill in the art.

A protective resilient, non-skid pad 29 is provided and mounted in a position beneath support member 31. Pad 29 may be affixed to support member 31 by gluing, fastening such as by recessed screws, or other known methods. The purpose of pad 29 is to protect floor coverings from contact with support member 31 so as to avoid scratching and the like, as well as to keep apparatus 9 from skidding when in use. This pad also provides service in reducing vibration and noise. Four resilient end-caps 17 are provided to cover the ends of transverse members 27. End-caps 17 provide non-skid contacts between apparatus 9 and a floor or other support surface.

Another component illustrated in this embodiment is an optional support frame 14 for a novice user to hold on to for stabilization while using apparatus 9. Support frame 14, termed an Assistant Coach by the inventor, comprises a tubing structure 16, a cross member 13, and padded gripping areas 15. Tubing structure 16 may be a one-piece tube bent to form structure 16, or a combination of straight and curved pieces, which are provided and assembled to form structure 16. Steel or another form of durable tubing of an approximate 1-inch diameter may be used. Other sizes are also useful.

Gripping areas 15 (one on each side) may be formed of a durable synthetic material such as a dense polyurethane foam, vinyl, or other materials known for providing a gripping surface to tube handles and the like that are common in the field of exercise equipment. In one embodiment, gripping areas 15 may be removed such as by conventional methods known in the art. In another embodiment, gripping areas 15 are permanent such as sprayed on or glued. Cross member 13 may be manufactured from a durable plastic or other material such as sheet steel or aluminum. Cross member 13 may in some embodiments be welded to tube structure 16. In other embodiments, other known fastening techniques such as nut and bolt, or metal screws may be used. There are many possibilities.

Figure 2:
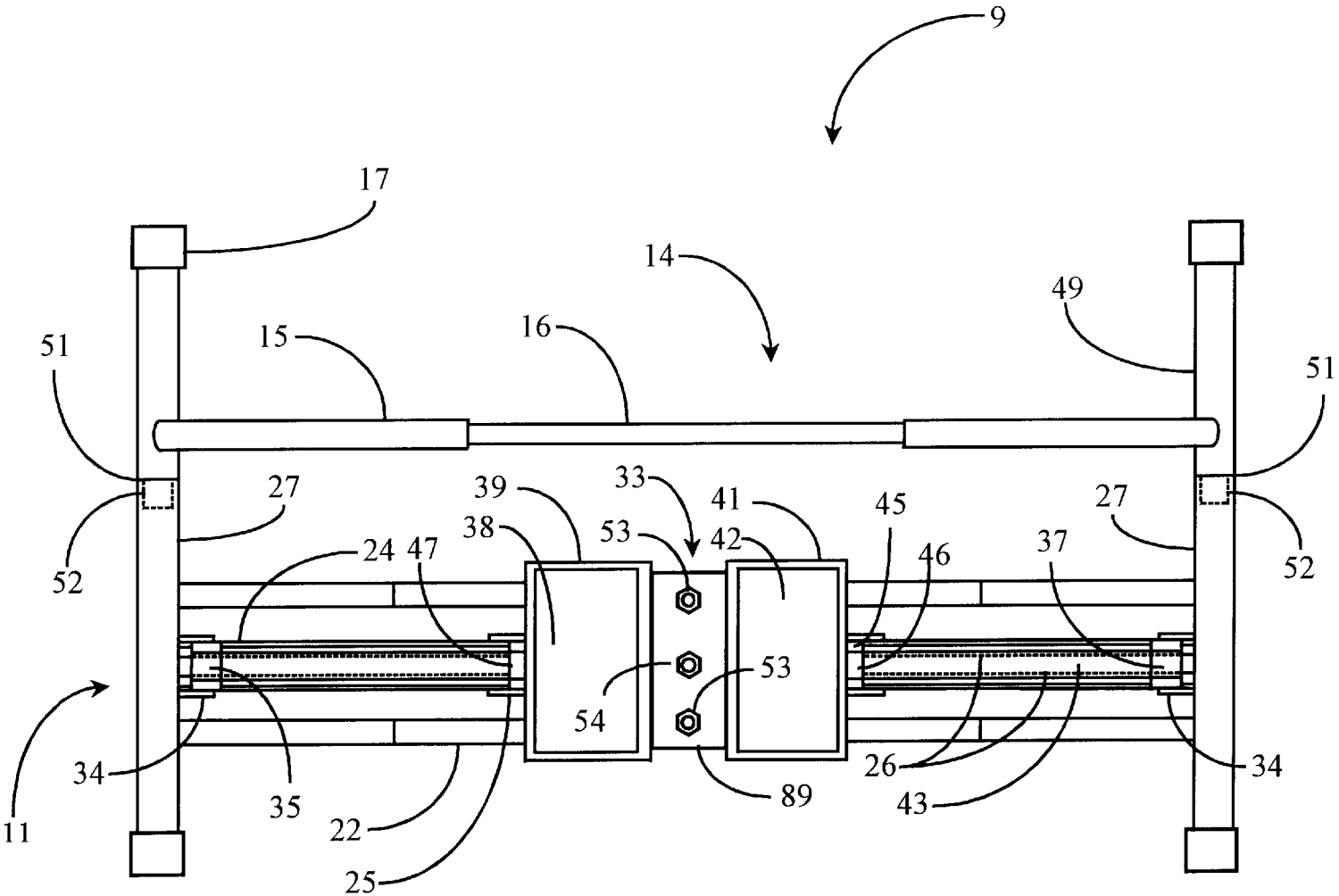
FIG. 2 is a plan view of the frame structure of FIG. 1 with added components illustrated according to an embodiment of the present invention.

Support frame 14 is welded or fastened to two transverse members similar to members 27 but not seen here because of the direction of view (see FIG. 2 element 49). Such members act as an optional extension to transverse members 27 at the rear of apparatus 9. By removing resilient end-caps 17 from the rear or front of apparatus 9, support structure 14 may be connected to the transverse members 27 of frame structure 11. In some embodiments an additional interface and support element is added between elements 11 and 27.

FIG. 2 is a plan view of the frame structure 11 of apparatus 9 of FIG. 1 with added components illustrated according to an embodiment of the present invention. As previously described, support frame 14 is an optional extension to frame structure 11 of apparatus 9. A user wishing to install support frame 14 simply removes two end caps 17 from the rear of frame structure 11 and connects the support frame. The point of connection for the two structures is illustrated as line 51 at either end of device 9.

Transverse members 49 each have a fitting end 52 that is of a smaller diameter over a suitable length than the inside diameter of transverse members 27. The diameter is small enough so that transverse members 49 may be easily fit into transverse members 27 such that when fully inserted lines 51 are formed representing the joining of each structure. Circular shims (not shown) that are once split through along a longitudinal edge of each shim are used to obtain a snug fit between transverse members 27 and 49. Such shimming methods are well known in the art. Setscrews (not shown) or other known types of fasteners may be used to secure the installation.

As seen in this overhead view, power band guides 24 extend from each end of the structure (members 27) toward the center and are welded at opposite ends to structure 25, which in turn welds to member 31 (FIG. 1A). Roller brackets 34 are welded to transverse members 27 and to belt guide 24 as previously described above. Two rollers 47 and 45 are illustrated as mounted to tensioning structure 25. Rollers 47 and 48 are provided and adapted to support a central power band 46. Likewise, a power band 43 is supported by rollers 35 and 37. An additional roller (not shown) is provided for further support of power band 46 and is centered in-line and in-between rollers 47 and 45 at a raised position such that a triangular configuration of the three rollers is formed. Power bands 43 and 46 are manufactured of a proprietary rubber compound or similar material as described in U.S. Pat. No. 5,147,257. Aforementioned rollers such as rollers 35 and 37 are manufactured of polypropylene or similar material in a preferred embodiment.

Tension-adjustment structure 25 acts as a rigid mounting location for rollers 47 and 45. A plurality of openings provided in collinear arrangement through opposite-facing sides of structure 25 are used to mount rollers 47 and 45 via a quick-release pin-and-shaft mounting technique that is described in detail later in this specification. By removing and re-mounting rollers in different positions on structure 25, tension adjustments to power band 46 may be affected.

Figure 4:
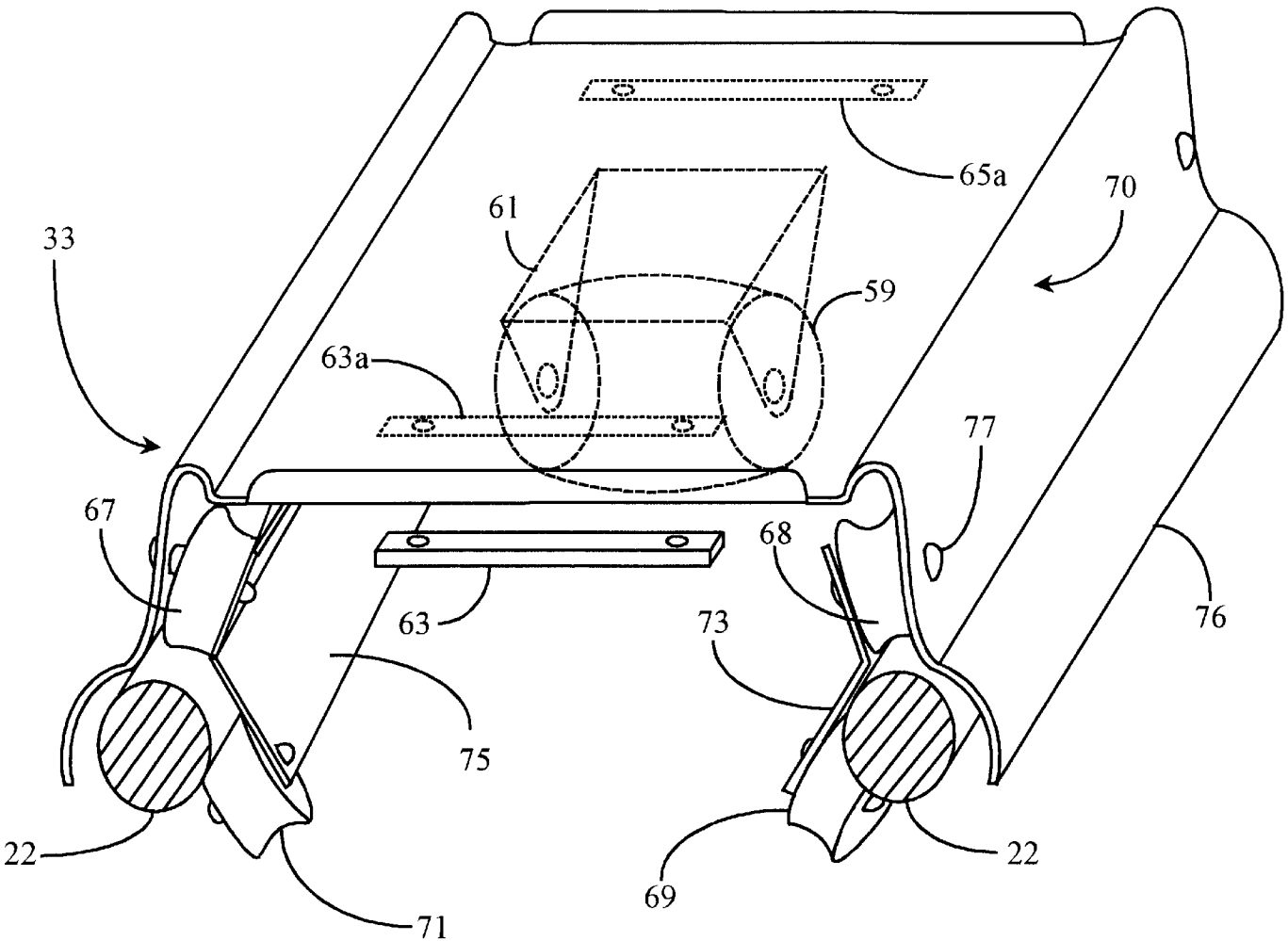
FIG. 4 is a perspective view of a wheeled carriage-assembly shown without an upper carriage according to an embodiment of the present invention.

A wheeled lower carriage assembly indicated as element 33 in FIG. 2, but best seen in FIG. 4, rides on rails 22. This carriage is described in further detail below with reference to FIG. 4. Foot platforms 39 and 41 are mounted to an upper platform unit 89, which in turn mounts to the lower wheeled carriage assembly by fasteners 53. The arrangement of an upper platform for footpads mounting as a unit to a lower wheeled carriage allows different footpad arrangements to be quickly and easily traded on a standard wheeled carriage.

Center fastener 54 is not used when installing and removing upper foot platforms, because it is a mounting fastener for a power-band roller beneath carriage 33. A clearance hole is provided in the upper platform for this fastener.

Foot platforms 39 and 41, in the arrangement shown, provide a parallel skiing simulation that is one option for mode of operation with apparatus 9. By swapping upper platforms with different foot interface arrangements the overall apparatus can be quickly adapted to other applications, as will be clearer with following description.

In the embodiment shown, foot platforms 39 and 41 each have a footpad surface thereon. Footpad surface 38 is affixed to platform 39, and footpad surface 42 is affixed to platform 41. Footpad surfaces 38 and 42 are preferably made of a non-skid durable rubber material. Surfaces 38 and 42 may be installed using an adhesive, or other known methods such as screw fasteners or the like. Similarly, other materials may be used instead of rubber as long as a non-skid effect is maintained.

Rollers 35, 37, 47, 45, and the previously described roller (not shown) that completes a triangular configuration with rollers 47 and 45 are now significantly larger in diameter than rollers previously disclosed in related applications. Whereas previously disclosed rollers were described as having about a 1-inch (2.5 cm) diameter, the rollers of the present invention have substantially a 2-inch (5 cm) diameter and are crowned. That is, the rollers are somewhat curved on the outer surface that meets the power band, so there is a marginally larger diameter at the center plane of the roller than at the roller edges. This improvement in design ensures that the power bands always remain centered on the rollers, which obviates contact with roller brackets and the like, reducing frictional wear to the power bands, and leads to smoother and quieter operation of apparatus 9.

Figure 3:
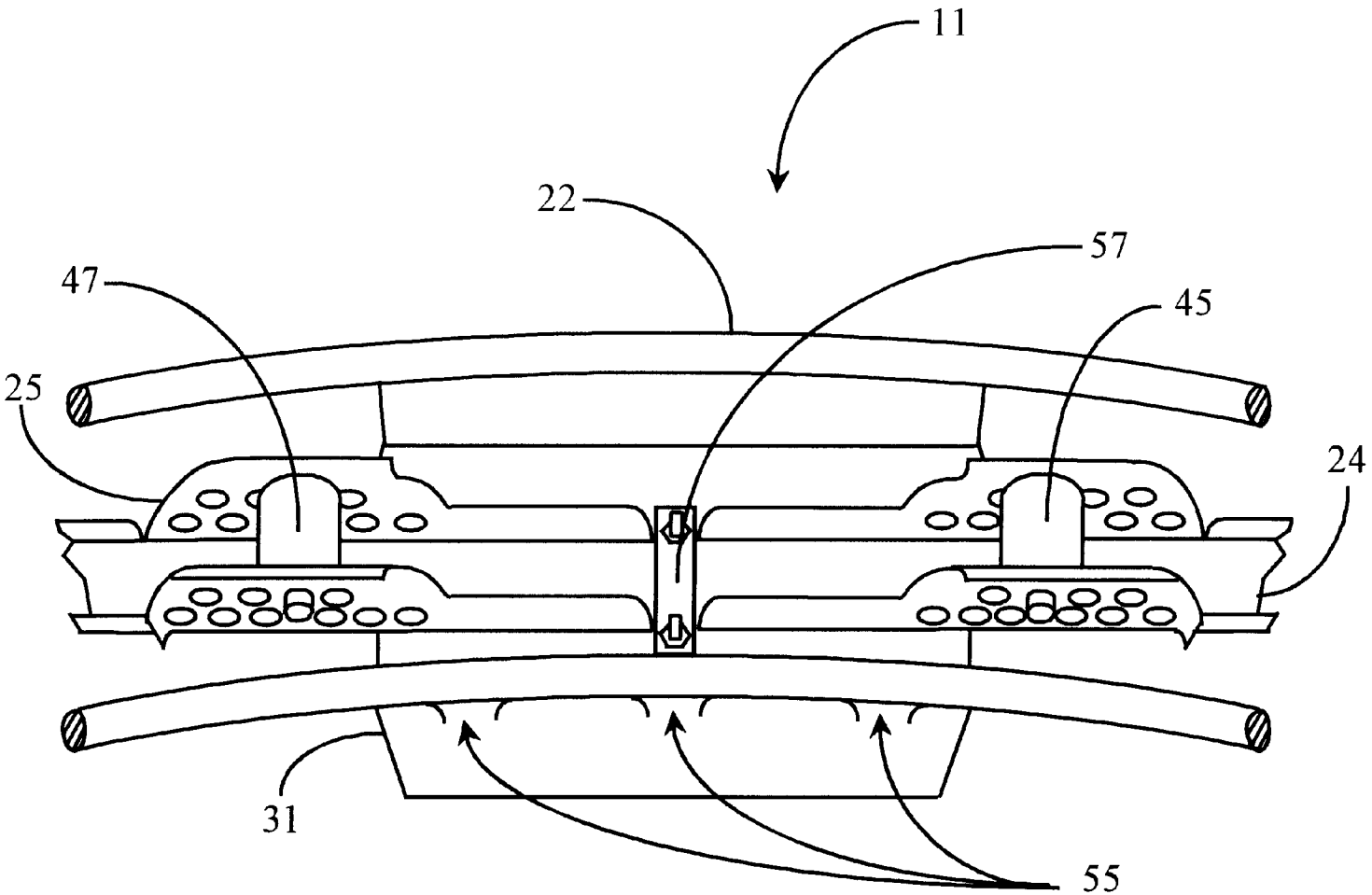
FIG. 3 is a perspective view of a center portion of the structure of FIG. 1 with covering components removed.

FIG. 3 is a perspective view of the center portion of frame structure 11 of FIG. 1 with covering components removed to show the elements beneath. As previously described, support member 31 is welded to rails 22. In this example, a plurality of individual welds 55 is placed symmetrically along the length of support member 31. There are three welds 55 shown in this example, however, there may be more or fewer such welds without departing from the spirit and scope of the present invention. In one embodiment, a continuous weld may run the entire length of support member 31. Also in this example, welds 55 are illustrated as being placed from the outside edges (rear-edge welds not visible) of support member 31 to the outside of rails 22. There are many possibilities regarding number of and location of welds 55.

Tensioning structures 25, as described with reference to FIGS. 1 and 2, are welded to belt guides 24 and to support member 31. Brackets 25 are shown with rollers 47 and 45 mounted thereon. A suitable thickness for the material used to manufacture support member 31 and belt guide 24 is about 3 mm. or ⅛ of an inch. In one embodiment of the present invention, aircraft quality aluminum may replace sheet steel for such components where possible. Using high quality aluminum instead of materials such as steel cited in related applications helps to strengthen frame structure 11 as well as to reduce weight.

Yet another marked improvement over the prior art is in the method of clamping the ends of power bands. In related documents it is described that the central resilient element has it's ends clamped at one location while a second resilient element has its ends clamped at locations on either side of the central clamp. Therefore three clamping locations exist for securing the free ends of power bands. In this example, only one clamping location 57 is required. Clamp 57 secures both the ends of power band 43 and those of power band 46 of FIG. 2. This method reduces work-steps required to install power bands. A single clamping location also ads considerable safety in that only one clamp must be checked for integrity therefore lessening the possibility of error in set-up. In this particular example, clamp 57 is a bar clamp utilizing two standard hex-head nuts and bolts to effect tightening.

FIG. 3 also illustrates the positioning of rollers 45 and 47 in structures 25. The position of the rollers in this embodiment can be changed into any other of the holes in the sides of structures 25 to adjust the tension on the inner power band.

FIG. 4 is a perspective view of wheeled carriage-assembly 33 shown without an upper foot-platform 89 according to an embodiment of the present invention. As disclosed in related applications such as U.S. Pat. No. 5,147,257, for example, there are four main weight-bearing wheels that are mounted to the carriage body and adapted to make contact on the upper surfaces of rails 22 such that the carriage assembly may ride side-to-side on the rails as urged by a user. The wheels are approximately 2 cm wide and are machined using an ultra high molecular weight (UHMW) long-chain polymer material as described in U.S. Pat. No. 5,147,257. A standard button-head shoulder-bolt (not shown) forms the shaft of each wheel. Ball bearings, washers, a lock washer, and a castle nut complete the assembly components for mounting wheels to the carriage body as described in U.S. Pat. No. 5,147,257.

As in '257, there are four main wheels that ride on upper surfaces of rails 22. Two are visible in this embodiment and are represented by element numbers 67 and 68. The remaining two main wheels are located toward the rear portion of carriage assembly 33 and are therefore hidden from view by carriage body 70, and are not represented in FIG. 4 to avoid unnecessary detail. These main wheels are mounted rotationally to carriage body 70.

Wheels 67 and 68 in a preferred embodiment are mounted at an approximate 12 degree angle from vertical with the angle toward the space in-between rails 22 such that they make contact with a more inwardly surface of each rail. The rolling surface of each wheel is concave such that the radius across the width of each wheel substantially matches the cross-sectional radius of rails 22. Wheels 67 and 68 as well as two main wheels that are not visible here are mounted through provided openings strategically located on carriage body 70.

In this embodiment, an additional set of four keeper wheels is provided of which two wheels 71 and 69 are visible in this view. Two other keeper wheels are located toward the rear of carriage assembly 33 and are hidden in this view by carriage body 70. Components forming the shaft and mounting hardware for keeper-wheels 71 and 69 are the same as those already described for wheels 67 and 68.

Keeper wheel 71 and 69 are strategically located beneath rails 22 at angled positions that are inverted from the angled positions of main wheels 67 and 68, and directly below weight-bearing wheels. Two angled mounting brackets 75 and 73 are provided and adapted to secure keeper wheels 71 and 69 by being also mounted to upper wheels 67 and 68. Wheels at the rear of carriage assembly 33 (not shown) are similarly secured as brackets 75 and 73 run the entire length of carriage assembly 33, In this embodiment brackets 73 and 75 are secured to the upper wheels and the lower wheels, so the lower keeper wheels are positioned by the upper wheels, which are mounted to the carriage body. In other embodiments brackets 73 and 75 may extend further upward and be fastened to the underside of the carriage, such as by rivets or welding. The brackets may, for example, be fastened by any convention joining means. Angled mounting-brackets 75 and 73 assume an inclusive angle of approximately 140 degrees such that each wing is substantially parallel to desired wheel positions when mounted. Ideally, carriage assembly 33 will remain resident on rails 22 when changing applications. This will allow for interchangeability of pre-assembled modules that are complete with selected foot platforms mounted. Upper platforms such as platform 89 of FIG. 2 may vary in physical appearance depending on the application; however, identical fastening locations allow interchangeability with carriage assemblies such as carriage assembly 33.

There are yet additional improvements made to assembly 33 over the prior art. One such improvement is the provision of two clamping locations 63*a* and 65*a* located on the under-surface of carriage body 70 for the outer power band. A clamp bar 63 is illustrated as one of two such clamp bars that are used to secure resilient element 43. A second clamp bar for clamping location 65*a* is not shown, but may be assumed to be present. Previous embodiments disclosed in related documents describe only one clamping location located directly beneath the center of the carriage assembly. An advantage of having power band 43 clamped in two locations is that noise caused by a resilient element flapping against the underside of the carriage body is eliminated, and the carriage is stabilized even further.

Roller 59 is a third roller previously described to form a triangular configuration of rollers to support power band 46 of FIG. 2. Like all rollers described in this specification, roller 59 is crowned for the purpose of guiding resilient member 46 such that it remains centered on the rollers.

In this embodiment, roller 59 assumes a position much nearer in proximity to the underside of carriage body 70 than in the cross-referenced patents. This is due in part to the larger diameter (2 inch) attributed to rollers of the present invention as opposed to previously disclosed 1 inch diameter rollers in related documents. In addition, roller 59 is simply mounted in a position that is nearer the underside of carriage body 70 by means of a roller bracket 61. This is done to reduce wear caused by resilient members rubbing and slapping against each other, and also, to reduce associated noise. The clearance is carefully designed as well so that, as the roller carriage moves to each side and back on the rails, the slack portion of the outer power band is carried to the side in the direction of carriage motion, which also reduces noise and sudden engagement.

It will be apparent to one with skill in the art that there are other possible wheel arrangements that may be used with carriage assembly 33 than the one illustrated herein without departing from the spirit and scope of the present invention. For example, the tilt angle of main and keeper wheels may be more or less than 20 degrees as mentioned in this embodiment. There may also be more or fewer main and or keeper wheels than is illustrated here.

In one embodiment, independent wheel pairs comprising one main wheel and an associated keeper wheel may be bracketed independently such that there are four independently movable wheel sets.

Figure 5:
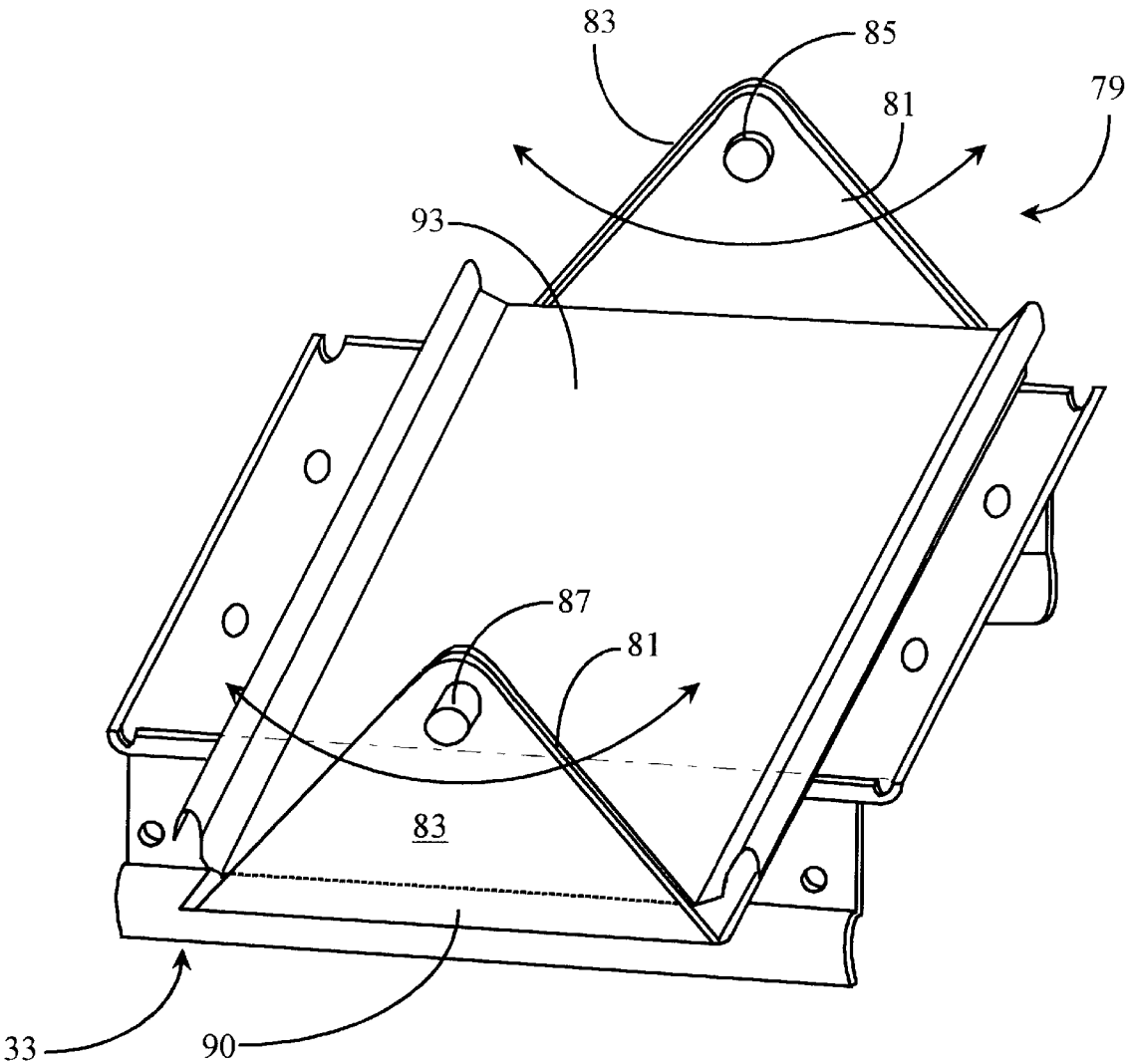
FIG. 5 is a perspective view of an upper carriage-assembly supporting a suspended footpad mounted according to an embodiment of the present invention.

FIG. 5 is a perspective view of an upper platform assembly 90 supporting a suspended footpad 79 mounted to a carriage assembly 33 (wheels and brackets not shown) according to an embodiment of the present invention.

In this example, a single suspended footpad 79 is provided and adapted to be pivotally suspended over upper platform assembly 90, termed a cradle in related U.S. Pat. No. 5,020,793, by means of two pivot points 85 and 87. Each pivot point 85 and 87, in a preferred embodiment, comprises a journal bearing, a spacer bushing, and a threaded stud with suitable lock washers and a nut fastener. There are equivalent ways known in the art to accomplish such a pivot. A suitable rubber cover is provided and adapted to fit over pivot points 85 and 87 to protect components from corrosion and general exposure. Pivot points 85 and 87 are arraigned in collinear fashion on opposite facing support wings represented by element number 81. The pivots are fixedly mounted in vertical structures 83, which are a part of the platform that mounts to carriage 33. As described in U.S. Pat. No. 5,020,793, footpad 79 may swing freely about pivot points 85 and 87 as illustrated by double arcs that represent direction of swing.

The general application illustrated in this example is as stated in the aforementioned related document whereas a user places only one foot in footpad 79 after it is installed on apparatus 9 of FIG. 1. By traversing back and forth over rails 22 of FIG. 1, he or she experiences a benefit of simulated edging. As the length of traversing approaches maximum length of rails 22, footpad 79 pivots maximally about pivot ends 85 and 87.

Also noted herein is a no-skid surface 93 provided in the same fashion as previously disclosed in FIG. 2 (elements 38 and 42). The fasteners for mounting the upper platform to carriage 33 are not seen in this view, but are the same as previously described for upper platforms in this disclosure.

According to a preferred embodiment of the present invention, footpad 79 with upper platform assembly 90 may be removed as one unit from and installed as one unit onto any wheeled carriage-assembly having suitable mounting locations. In this way, a carriage assembly such as assembly 33 of FIG. 2 may be kept resident on apparatus 9 of FIG. 2 with the loosening, removing, and re-tightening of only two hex-head nuts being required to change applications. This method reflects the modular nature of accessories such as footpad 79 mounted to upper platforms according to a preferred embodiment. Loosening and tightening bolts may be performed with the aid of a convenient T-handle socket tool (not shown) adapted to fit hex-head nuts 53. In a preferred embodiment, all hex-head nuts subject to requirements of being removed and replaced due to the change of applications are the same size fitting the T-handle socket tool.

Carriage assembly 33 is shown in this example to illustrate orientation of footpad 79. Carriage assembly 33 may be of a different overall length than assembly 33 of FIG. 2. For example, a single footpad such as footpad 79 does not require a longer carriage assembly whereas a dual footpad installation would require a longer carriage assembly. In a preferred embodiment, carriage assembly 33 of FIG. 2 has a maximum length such that all modular accessories are supported. That is not to say, however, that a modular accessory cannot have it's own carriage of a different overall length.

Carriage assembly 33 of FIG. 2 would preferably remain resident on rails 22 of apparatus 9 (FIG.2), especially if keeper wheels are used as previously described. However, in an alternate embodiment where keeper wheels are not used, the carriage assembly illustrated in this example may have main wheels installed and may be thought of as one module comprising assembly 33, upper platform 90, and footpad 79. In this embodiment, a roller such as roller 59 of FIG. 4 may be shared between different applications. A quick release of roller 59 and removal of bar clamps such as clamp 63*a* of FIG. 4 will also allow removal and replacement of different modules. However, removing bar clamps entails much more effort on the part of a user. The added effort may be offset by the fact that different applications may require different tensioning adjustment with respect to a resilient member such as member 46 of FIG. 2.

In addition to providing a single footpad in modular fashion as illustrated herein, in a further embodiment an upper platform is provided having two such single suspended footpads may be mounted in spaced-apart fashion. In yet another embodiment an upper platform assembly is provided wherein the spacing between suspended footpads is adjustable, and the adjustment apparatus is described further below with reference to FIG. 12. Also, because of added keeper wheels such as wheels 69 and 71 of FIG. 4, retaining a wheeled carriage on rails 22, footpad(s) 79 may be significantly extended in length without the risk of tipping carriage 33 off of rails when in use.

Figure 6:
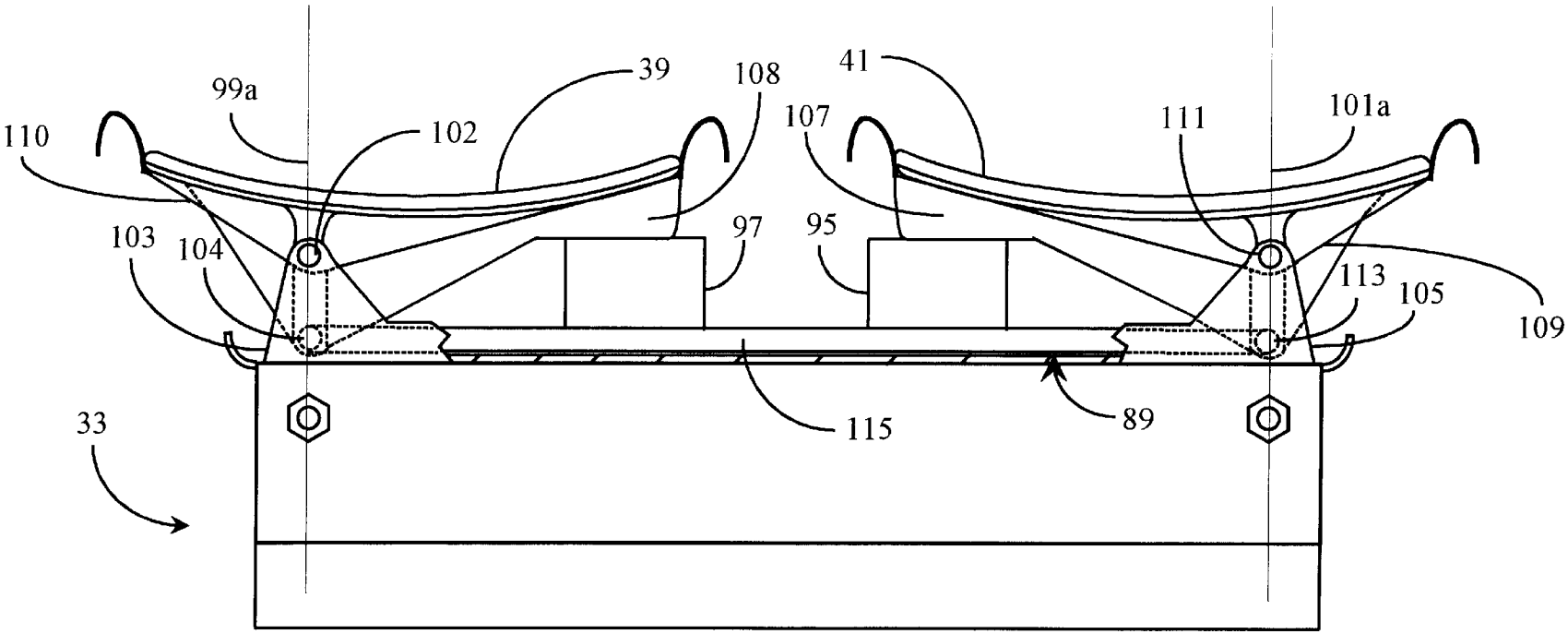
FIG. 6 is an elevation view of a wheeled carriage-assembly and mounted foot platforms according to an embodiment of the present invention.

FIG. 6 is an elevation view of wheeled carriage-assembly 33, upper platform 89, and mounted foot platforms 39 and 41 of FIG. 2 according to an embodiment of the present invention. Part of the upper carriage walls are broken out in this figure for the purpose of enabling a view of inner components, and the bottom plate of upper platform 89 is therefore shown partially in cross-section.

As with previously disclosed embodiments described in related documents, footpads 39 and 41 are pivotally mounted to pivot supports 103 and 105 respectively. Supports 103 and 105 are part of the upper-platform assembly not removed in this example. There are four pivot supports such as supports 103 and 105 with the remaining two identical supports positioned directly behind and to the backside of assembly 33 and therefore not seen in this view. Pivot pins 102 and 111 form a pivotal connection between depended ears 109 and 110 and an identical set of depended ears (not shown) located at the backside of footpads 39 and 41 respectively. A section-view of this relationship is detailed and described in '257 FIG. 6. Footpads 39 and 41 are die-cast in one embodiment to include the described depended ears.

A link-rod 115 is provided and attached to pivot points 104 and 113. The above-described configuration including components is duplicated at the backside of the assembly.

The connected link-rod assembly enables footpads 39 and 41 to pivot in unison during operation of apparatus 9 of FIG. 2. Resilient blocks 97 and 95 are provided as shock absorbers and are made of rubber or other suitable resilient materials.

Link-rod 115 is of a length such that when attatched to pivot points 104 and 113 with footpads 39 and 41 brought to their center-most position about pivot rods 102 and 111, that each footpad is canted, in some embodiments, somewhat toward the center (canted positions not specifically shown). However, in other embodiments it is desired that footpads 39 and 41 may be adjusted to assume a more level profile to facilitate use by more experienced users.

There are two ways to accomplish this task. In one embodiment, a second set of link-rods (not shown) is provided of a shorter overall length than the set represented by link-rod 115. By replacing link-rods 115 with the shorter rods, footpads 39 and 41 may be canted to a more level position. This, of course assumes that footpads 39 and 41 as used, in this embodiment, with link-rod 115 are canted in as described above. This method requires that four link-rods be provided with the modular footpad-assembly, two for the canted-in configuration, and two for the more level configuration.

In another embodiment link rods are provided that are themselves adjustable, so the effective length of the rods, and therefore the degree of cant of the footpads may be adjusted within certain limits.

Figure 7A:
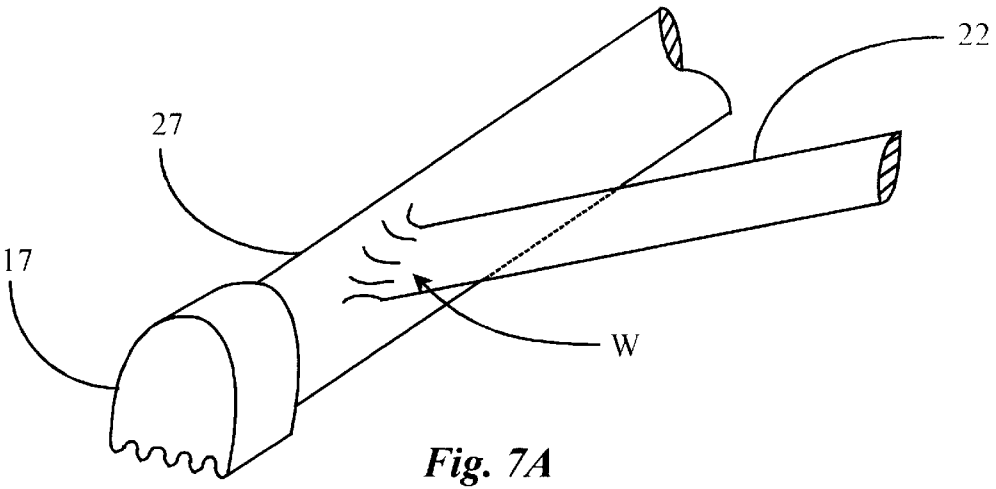
FIG. 7A is perspective broken-view of a portion of a rail, transverse end member, and end-cap according to an embodiment of the present invention.

FIG. 7A is perspective broken-view of a portion of a rail 22, transverse end-member 27, and end-cap 17 according to an embodiment of the present invention. In a preferred embodiment, rails 22 are welded to a location (W) above the longitudinal centerline of transverse end-members 27. The higher location allows keeper wheels such as wheels 71 and 69 of FIG. 4 from coming in contact with the floor at maximally traversed locations on rails 22. End-cap 17 now has a corrugated bottom for shock absorption as well as additional no-skid protection.

Figure 7C:
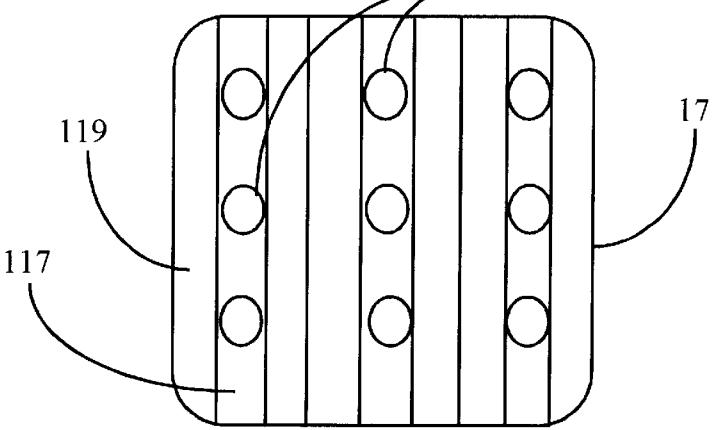
FIG. 7C is an elevation view of a bottom-side of the end cap of FIG. 7B.
Figure 7B:
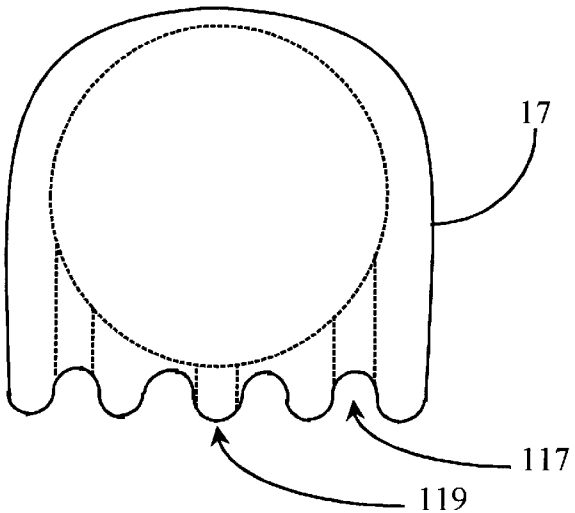
FIG. 7B is an elevation view of an end-side of the end cap of FIG. 7A.

FIG. 7B is an elevation view of an end-side of end cap 17 of FIG. 7A. End-cap 17 is molded of rubber-like material as described in previous embodiments. In order to improve over previous designs, a series of alternating raised portions 119 and grooves 117 are provided to form a corrugation feature extending across the bottom surface of cap 17. As described above, this adds a no-skid enhancement and a shock absorption enhancement.

FIG. 7C is a plan view of a bottom-side of end cap 17 of FIG. 7B. In addition to a corrugation formed by hills 119 and valleys 117, a pattern containing a plurality of through openings is provided generally through the bottom surface of end cap 17 and extending into the inner space reserved for housing the circular end of transverse member 27 of FIG. 7A. These openings are also illustrated in FIG. 7B as vertical dotted lines but are not described or witnessed. Openings 121 provide additional shock absorption capability. There are nine such openings in this example, however, it will be apparent to one with skill in the art that more or fewer openings 121 may be provided. Moreover, differing patterns may be used as well.

Figure 8:
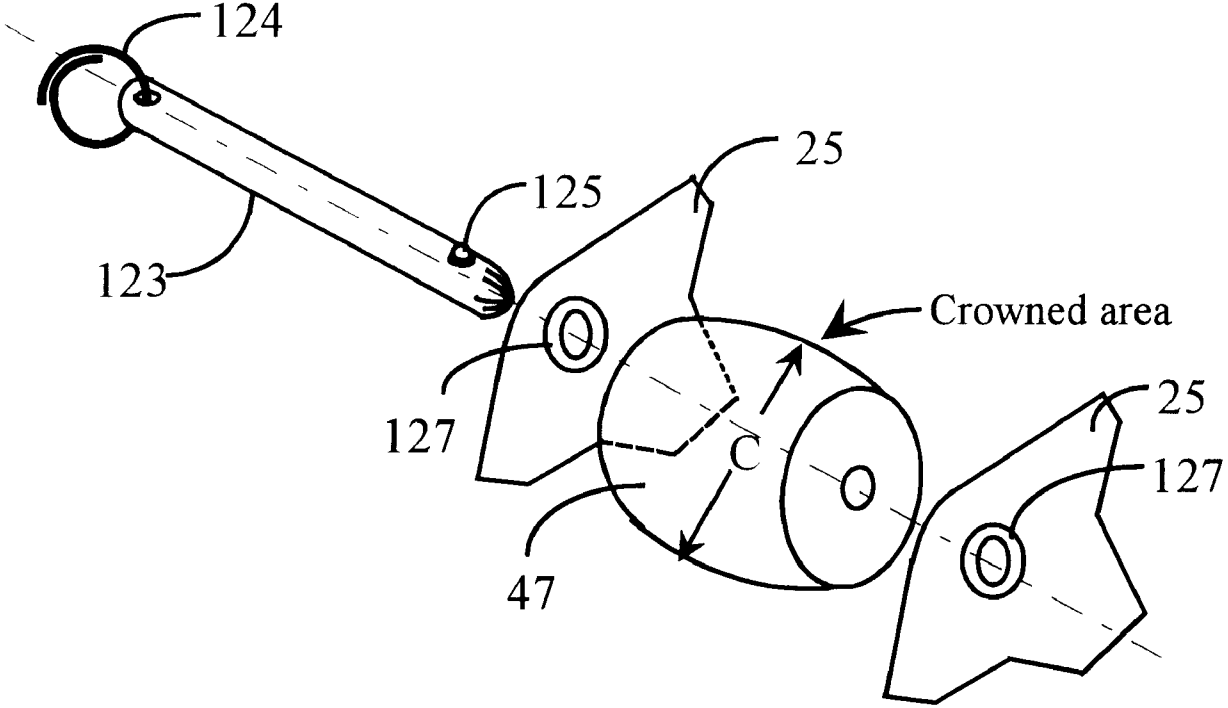
FIG. 8 is a perspective view illustrating various components of a quick-release roller assembly according to an embodiment of the present invention.

FIG. 8 is a perspective view illustrating components of a quick-release roller-assembly according to an embodiment of the present invention. As previously described in FIGS. 2 and 4 above, rollers supporting power bands such as roller 47 illustrated here, are crowned. Such a crowned area is labeled and illustrated by an accompanying witness arrow. A dimension C represents the diameter of roller 47 at the crowned area. It has been described above that a preferred diameter is 2-inches for rollers, which is assumed to be taken at the crowned area leaving the end diameters of each roller less than two inches in diameter. However, in some embodiments, the crowned area of a roller such as roller 47 may be larger than 2-inches.

A roller shaft or pin 123 is provided and adapted to be an axle for roller 47 between elements of structure 25 of which broken portions are represented here. Pin 123 has a spring-loaded detent 125 in one end and a pull ring 124 through a hole in the other end. Through-openings in elements 25, each having a polymer bushing 127, are provided to receive pin 123. By placing a roller in position between brackets 25, pin 123 may be placed through selected collinear bracket-holes with bushings 127 and roller 47. Pin 123 is of sufficient length such that it protrudes past the outer surfaces of structure 25 on both sides, and when in place detent 125 prevents accidental withdrawal. The quick-release pins for rollers provide a means of quickly re-positioning rollers in structure 25 for tensioning adjustment. In an alternative embodiment later described, the rollers may be adjustably spaced even more simply using a dialed adjustment mechanism.

Figure 9:
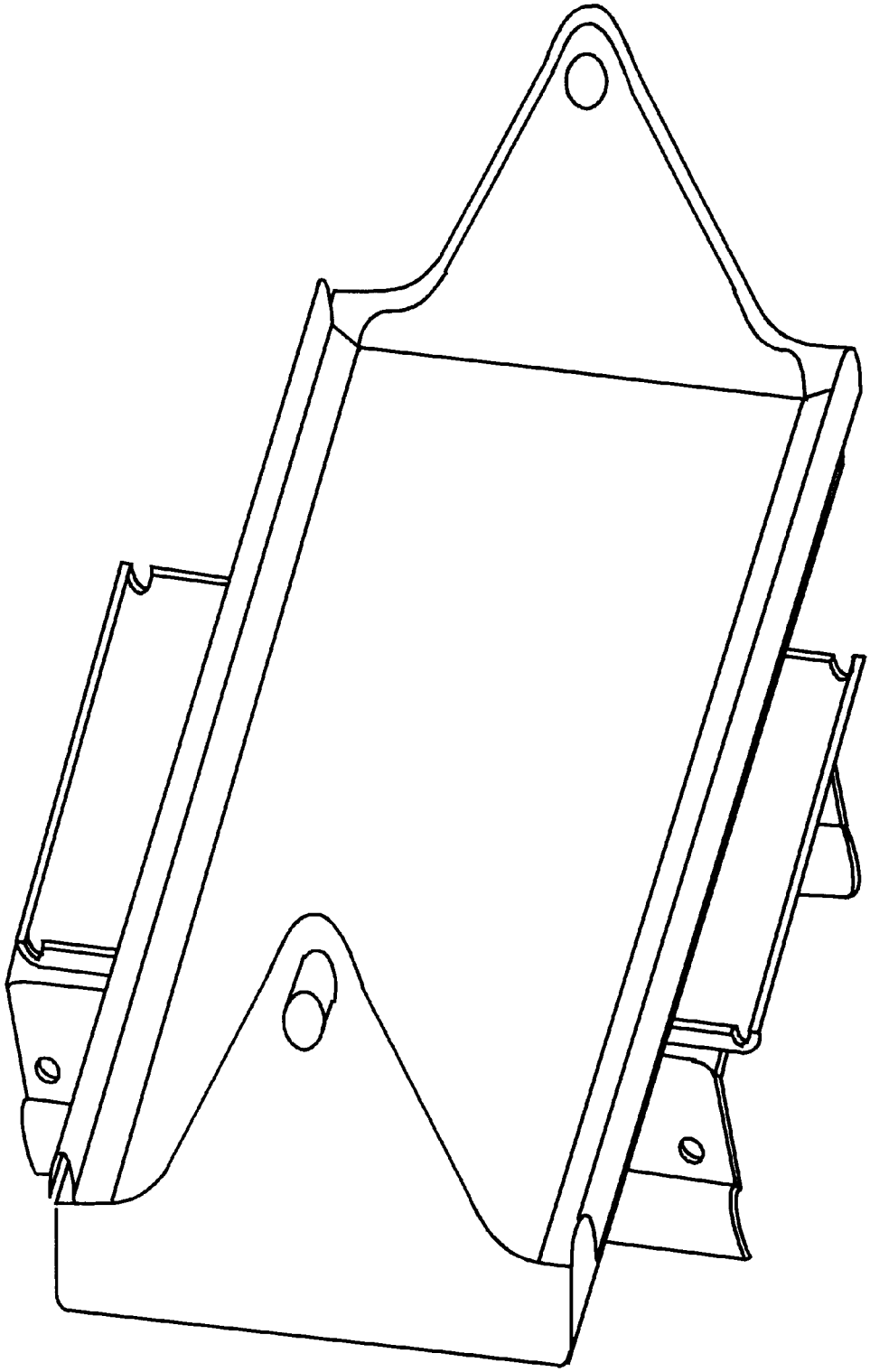
FIG. 9A is a plan view of an elongated footpad and carriage-assembly according to an embodiment of the present invention.
FIG. 9B is an elevation view of the footpad and carriage assembly FIG. 9A.
Figure 9A:
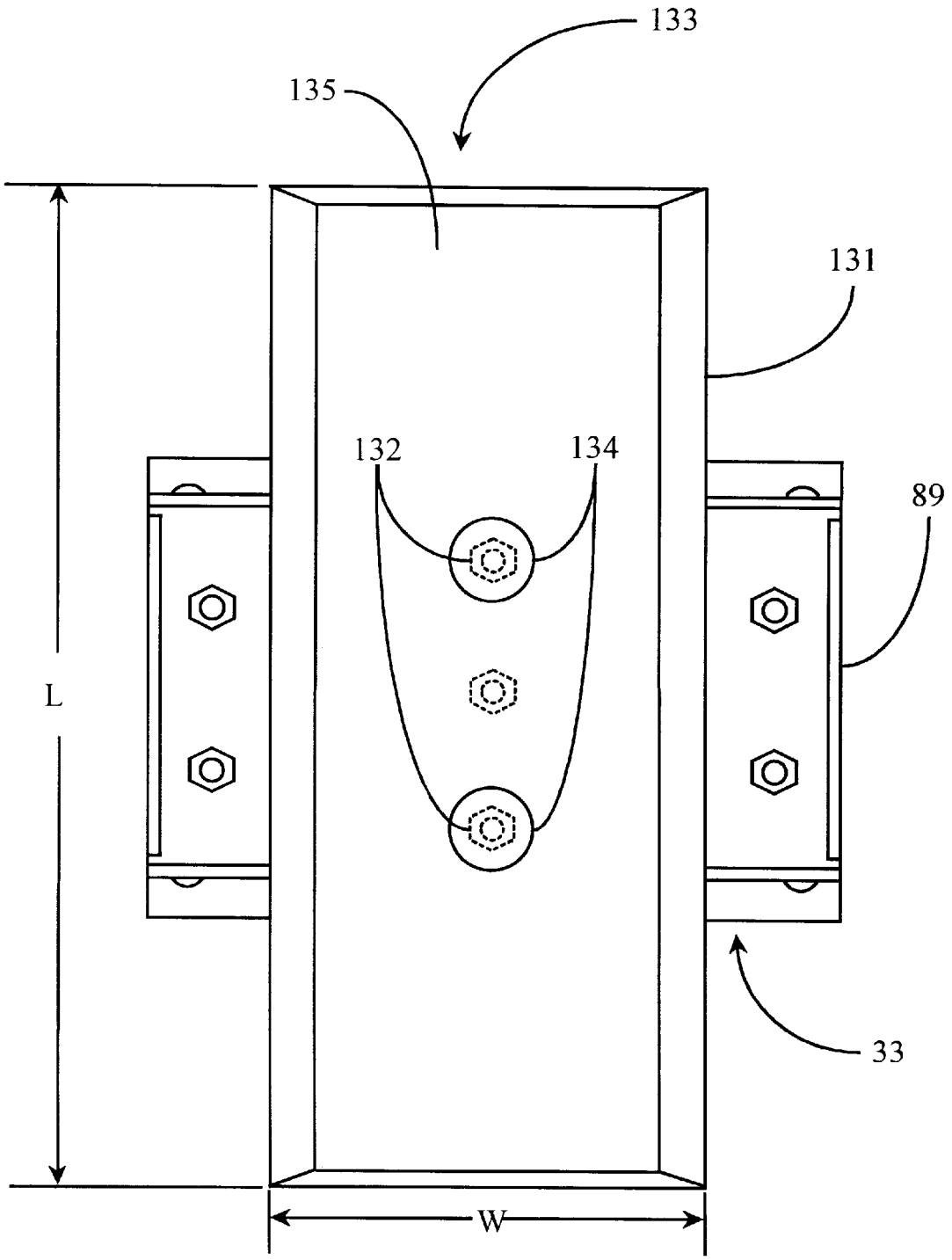

FIG. 9A is a plan view of an elongated footpad 133 and carriage-assembly 33 according to an embodiment of the present invention. A single footpad 133 is provided and adapted as a snowboard simulator presented as an option for apparatus 9 of FIG. 2. Footpad 133 is pivotally mounted to an upper platform assembly 89 in much the same fashion as footpads 39 and 41 of FIG. 6 except that footpad 133 is centrally mounted and there is no link-rod assembly required. Carriage assembly 33 is also illustrated in this example to show orientation only. A non-slip surface 135, preferably made of rubber-like material, is provided as in other embodiments previously described. Raised edges 131 are provided around the outer edges of footpad 133 for added protection from slipping.

A dimension L (length) is provided to be sufficient for allowing a user to place both feet on footpad 133 in positions similar to those used in snowboarding. A standard example would be standing sideways one foot spaced apart from the other about shoulder width. The exact dimension may vary according to application, however 25 inches should be sufficient for most users. A dimension W (width) is provided to be sufficient for covering the length of a users shoe or boot, about 15 inches.

In some embodiments not shown, there may be molded or otherwise formed positions to engage a user's feet, and fastening arrangements are also possible.

In another preferred embodiment of the invention the mounting of the single footpad for simulating operation of a snowboard is as shown for the footpads of FIG. 5, with the footpad suspended from pivots higher than the foot position.

The application presented here is only possible in an embodiment wherein keeper wheels are used such as wheel 71 and 69 of FIG. 4. Footpad 133 and upper platform 89 is a modular accessory and may be easily mounted to carriage assembly 33 of FIG. 2 by removing two hex-head nuts 132, placing the unit over carriage assembly 33 of FIG. 2 and then replacing and re-tightening the nuts. Clearance holes 134 are provided through footpad 133 to allow access for a T-handle socket-tool such as the one previously described in FIG. 5.

Figure 9B:
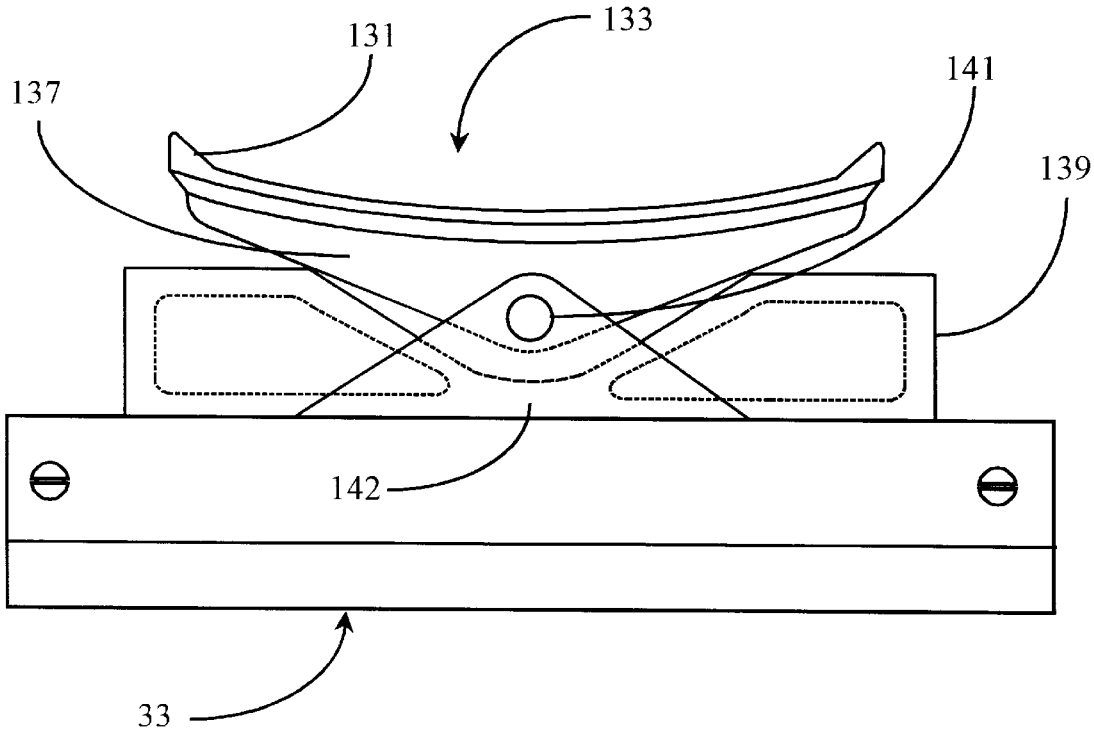

FIG. 9B is an elevation view of mounted footpad 133 of FIG. 9A. As described in previous embodiments, footpad 133 is die-cast. However, other suitable materials and forming methods may also be used. Depended ears 137 are provided at either end on the underside of footpad 133 for the purpose of accepting a pivot rod 141 through collinear and opposite facing openings. Pivot rod 141 also extends through collinear openings provided in support wings 142 arranged in similar opposite facing fashion as depended ears 137. When mounted, pivot rod 141 extends through all four collinear openings in depended ears 137 and support wings 142. Pivot rod 141 also extends through both walls of the upper platform assembly 89 of FIG. 9A (not shown). Pivot rod 141 may be secured to the above mentioned carriage walls by castle nuts or other types of fastening nuts (not shown) as described in U.S. Pat. No. 5,147,257.

In this example, there are no link-rods or other required hardware to direct rotation of footpad 141. Rather, a resilient stop is provided and adapted to stabilize the rotation of footpad 133 while in use. Stop 139 is analogous to resilient blocks 97 and 95 of FIG. 6 in that it acts to impede and direct rotation. However, resilient stop 139 is provided as one piece rather than two pieces in this example. Stop 139 also extends the length of carriage assembly 89 such that maximum support is afforded. When not in use, footpad 133 rests against stop 139 in a centered and level position.

In one embodiment, stop 139 has two areas within it's molded architecture that are hollow or perhaps filled with a less dense material than rubber. These areas are shown here by dotted polygonal shapes. The respective areas lie, one beneath the left side of footpad 133, and one beneath the right of footpad 133. When footpad 133 is in use such as on apparatus 9 of FIG. 2, the areas within stop 139 are caused to collapse under pressure of a respective side of footpad 133 during normal rotation. For example, each time a user traverses to one side of apparatus 9, the opposite-side area is caused to collapse. Several factors dictate the amount of collapse. These factors include a user's weight, speed of traverse, and any hard motions urged on footpad 133 by the user. Preferably, resilient stop 139 is manufactured to withstand sudden shock, and be strong enough to support a considerable stress without complete collapse. Advanced users may simulate back and forth movements experienced in snowboarding.

Figure 10:
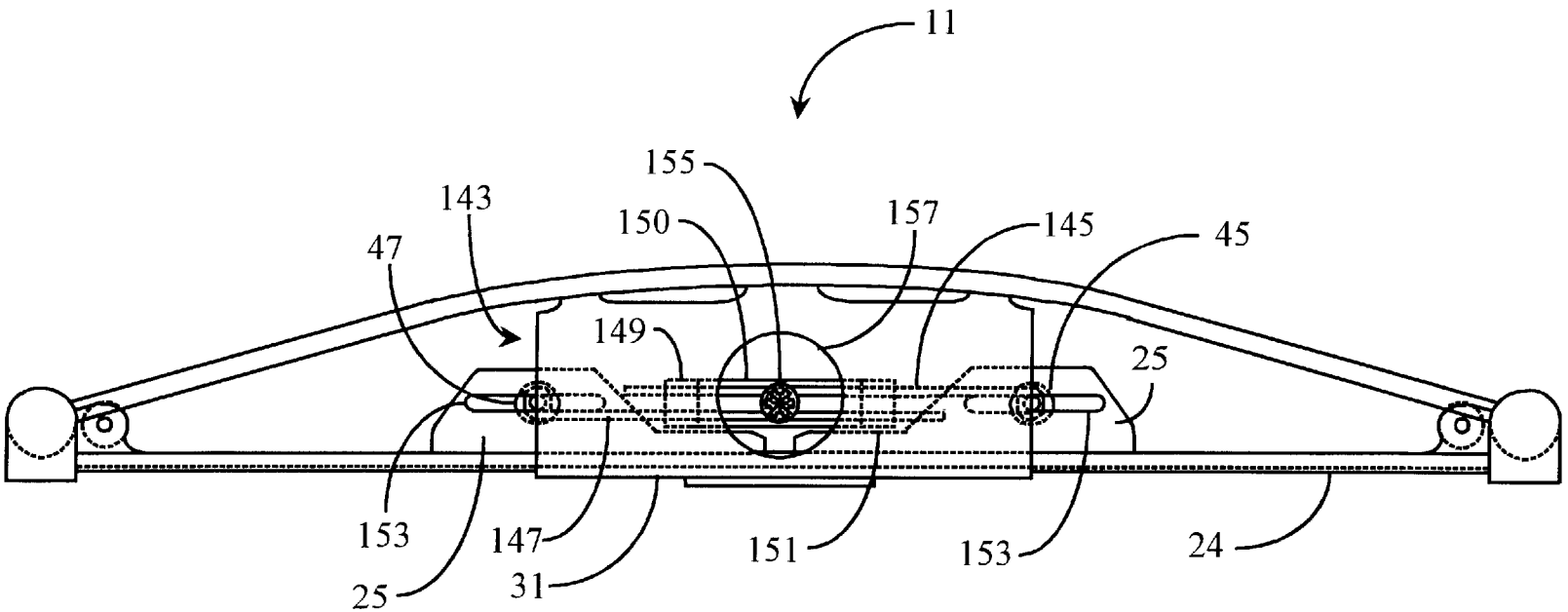
FIG. 10 is an elevation view of the frame structure of FIG. 1 illustrating roller-band tensioning hardware according to an embodiment of the present invention.

FIG. 10 is an elevation view of frame structure 11 of FIG. 1 illustrating an optional roller/band tensioning hardware 143 according to an embodiment of the present invention. According to this embodiment of the present invention, an optional apparatus and method is provided for tensioning a central power band such as band 46 of FIG. 2. Instead of a quick-release method for rollers as described in FIG. 5, whereby rollers are removed and then re-mounted in different positions, structure 25 on each side now has an elongated slot 153 for enabling a mounted roller such as roller 45 to be loosened and slidably positioned. Each structure 25 has opposite slots 153 on either side of belt-guide 24 such that a pair of slots 153 may accept a roller assembly such as for rollers 45 and 47.

Figure 11A:
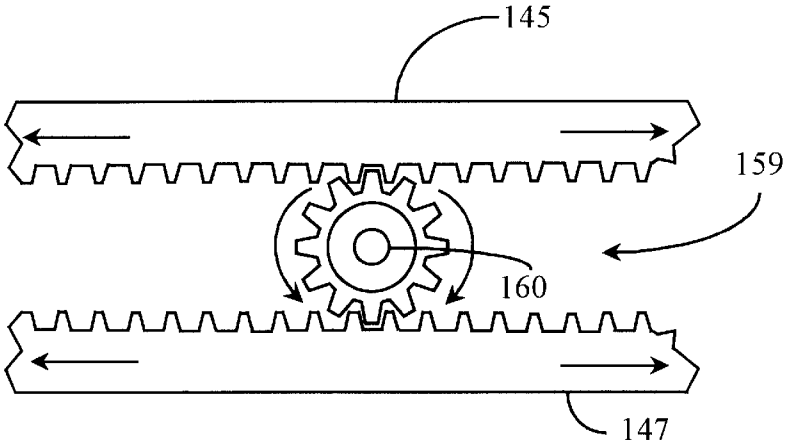
FIG. 11A is a broken view of a potion of toothed rails and a toothed gear of FIG. 10 according to an embodiment of the present invention.

Rollers 47 and 45 are, in this embodiment, held by an upper toothed-rail 145 for roller 45, and a lower toothed-rail 147 for roller 47, further illustrated in following FIG. 11A. Bracketed roller mounts (not detailed) on the roller side of each toothed rail form a rigid connection between the roller shafts of respective rollers to respective toothed rails. Toothed rail 145 is rectangular in cross-section and has a plurality of gear-teeth (not shown) arraigned along it's length in the manner of a gear rack. In some embodiments a standard gear rack may be used.

When positioned properly, toothed rail 145 presents it's gear teeth in a downward direction or along it's bottom surface. Toothed rail 147 is identical to toothed rail 145 and they are, in fact, interchangeable. An inverse positional relationship exists with toothed rails 145 (top rail) and 147 (bottom rail) such that respective gear tracks will face each other. Toothed rails 145 and 147 are held parallel and in position by a rail guide 150, as shown in FIG. 10 and 11C and D. Rail guide 150 has two rail-keepers installed thereon and adapted to hold toothed rails 145 and 147 in a parallel relationship and at the required distance apart. These are a rail keeper 149 positioned left of center, and a rail keeper 151 positioned right of center. The above-mentioned components of hardware 143 are manufactured of a durable material to provide wear resistance, for example, and there are several suitable materials for such applications.

A gear (pinion) 159, as shown in FIGS. 11A and B, is provided and adapted to mesh with opposite-facing gear tracks as presented on toothed rails 145 and 147. In this example, the gear is positioned directly behind of and forms a part of a gear-handle assembly 155. Hardware 143 may be conveniently mounted to the inside front surface of U-shaped support member 31 with conventional fasteners as known in the art. A cutout opening 157 is provided through the front wall of U-shaped support structure 31 to enable user access to a gear-handle assembly 155 for the purpose of adjusting tension. In some embodiments there is an access door.

In operation, a user adjusts power band tension to a greater or lesser amount by turning gear-handle assembly 155 clockwise (more tension) or counterclockwise (less tension). When the desired tension is achieved, he or she then releases a spring-loaded handle, and the positions are maintained. It may be assumed, of course, that a power band such as band 46 of FIG. 2 is in place during this operation. An incremental scale is preferably provided as a stamped or otherwise marked convention on the front face of support member 31, or along surfaces of the guides for the adjustment assembly. This will allow a user to return to known tension amounts without experimentation.

It will be apparent to one with skill in the art that a method for mounting hardware 143 to frame structure 11 may differ from the specific apparatus illustrated here without departing from the spirit and scope of the present invention. For example, U-shaped support member 31 may have a suitable slot running along its length for hardware 143 to fit into. There are other possibilities.

FIG. 11A is a broken view of a portion of toothed rails (racks) 145 and 147 and a toothed gear (pinion) 159 of FIG. 10 according to an embodiment of the present invention. Gear 159, as previously described in FIG. 10, is positioned between and meshes with toothed rails 145 and 147.

Figure 11B:
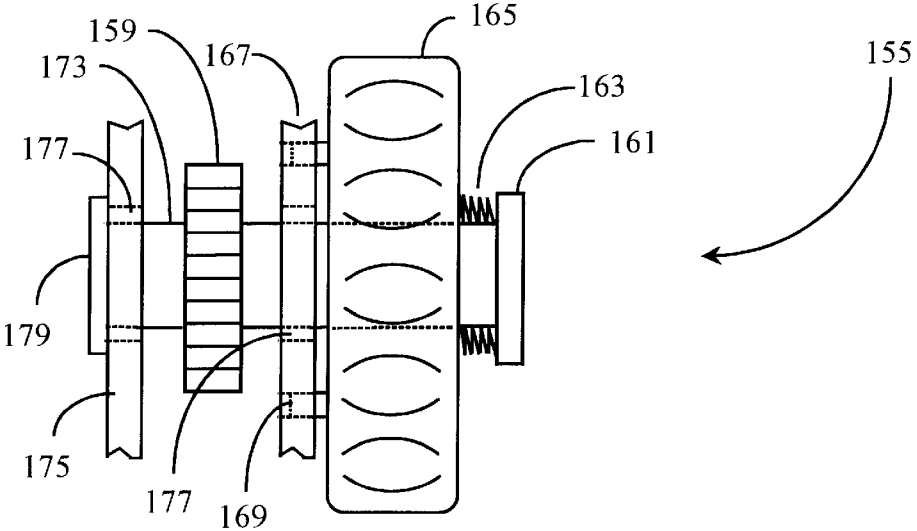
FIG. 11B is an elevation view of the handle assembly of FIG. 10.
Figure 11C:
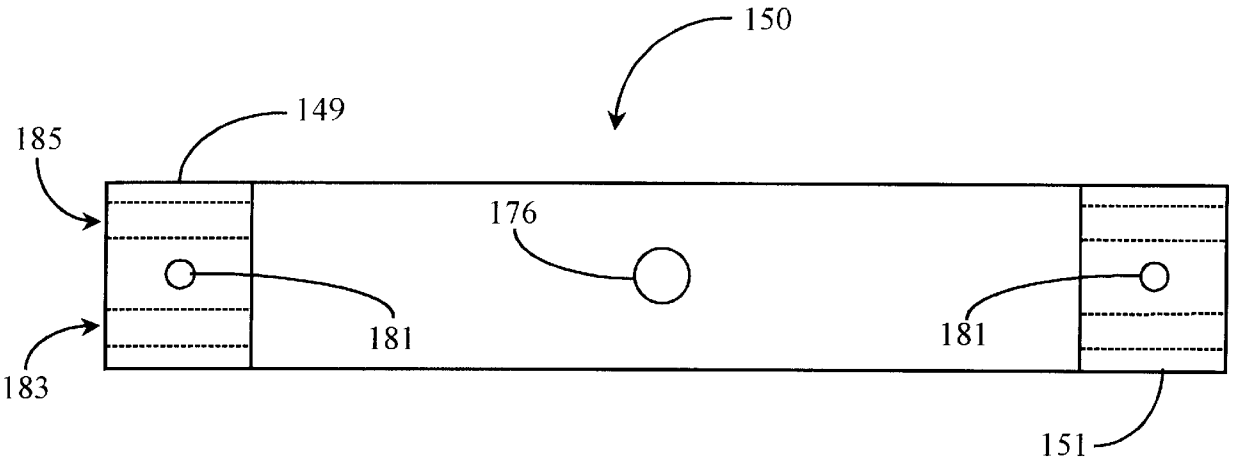
FIG. 11C is an elevation view of the rail-guide bracket of FIG. 10.

FIG. 11B is an elevation view of the handle assembly 155 of FIG. 10, and its integration with gear 159 and its mounting and operation. In this embodiment gear 159 is fixedly mounted to a shaft 173 that extends through opposite frame members 167 and 175 carried by bearings 177. A serrated wheel 165 is slidably mounted to shaft 173 outside the area of gear 159 by a spline on the shaft and the wheel. Shaft 173 has an end 161 and a compression spring which urges wheel 165 toward frame member 167. Pins 169 fit into matching holes in frame member 167, urged by spring 165. A user may grasp wheel 165, pull it toward end 161 against spring 165, whereby pins 169 are withdrawn from the matching holes in frame member 167, and the wheel is free to turn the gear. By turning the gear in either direction the user can then move rollers 47 and 45 either closer together or further apart, thus adjusting the tension on the power band. When the user releases the wheel, the spring causes the pins to re-engage, and the rollers are then retained in the new positions.

It will be apparent to one with skill in the art that there are many other mechanisms that may be employed to create a spring-loaded engagement handle for gear 159 without departing from the spirit and scope of the present invention. Other handle functions and assembly requirements may differ from the example shown here. The inventor intends the above-described handle assembly to be only one example.

Figure 11D:
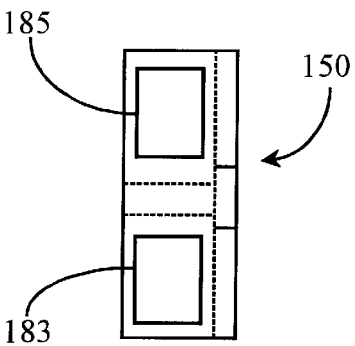
FIG. 11D is a right-side view of the bracket of FIG. 11C.

The skilled artisan will understand that supporting guide 150, as shown in FIGS. 11C and 11D, and other supporting elements for the rack-and-pinion mechanism described above may be accomplished in a number of different ways, and is within the skill of engineering practitioners. Detailed description of this portion of the mechanism is therefore not undertaken here.

Figure 11E:
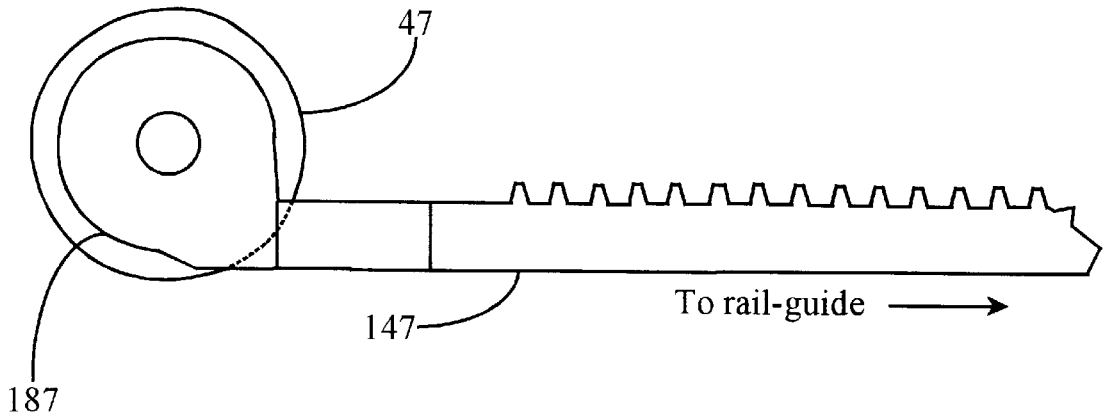
FIG. 11E is a broken view of a portion of the bottom toothed-rail, roller, and bracketed roller-mount of FIG. 10.

FIG. 11E is a broken view of a portion of lower rack 147, roller 47, and a bracketed roller-mount 187 of FIG. 10. As previously described, a roller such as roller 47 is mounted to a rack such as rack 147 by means of a bracketed roller mount shown here as element 187. Roller mount 187 is adapted to fit over the ends of a roller axle by virtue of a forked construction, similar in some respects to a mount for a paint roller, for example.

Figure 11F:
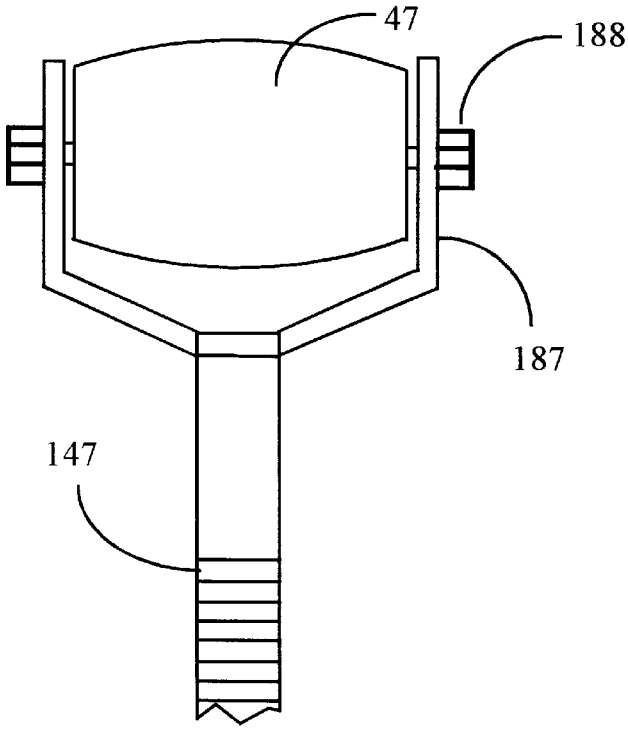
FIG. 11F is a broken view of the bottom toothed-rail, roller, and bracketed roller-mount of FIG. 10 as seen from an overhead vantage.

FIG. 11F is a plan view of the assembly of FIG. 11E. As can be seen in this view, roller mount 187 is a simple forked bracket structure fastened to the end of rack 147. Guide ends 188 are provided for guiding in slots of the rail guides 150 to constrain the translation direction in operation. In a preferred embodiment these guides are of a UHMW material for low-friction and for noise and vibration reduction.

Figure 12:
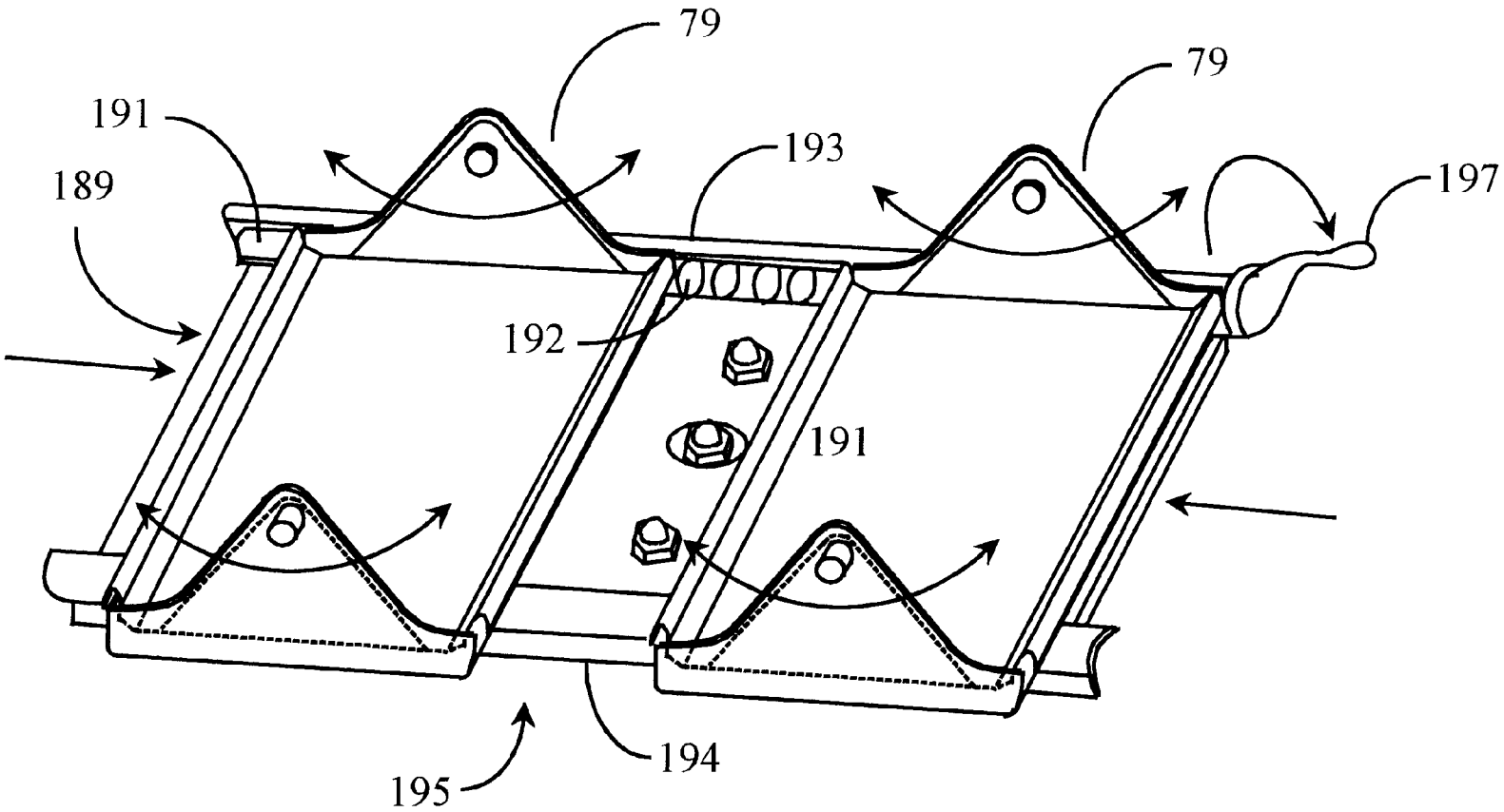
FIG. 12 is a perspective view of an adjustable double footpad module according to an embodiment of the preset invention.

FIG. 12 is a perspective view of an adjustable double-footpad upper module 195 according to a further embodiment of the present invention. This model is termed the Double Black Diamond model by the inventor. As previously noted in FIG. 5, a suspended footpad assembly such as footpad 79 may be double mounted in an adjustable manner. Two suspended footpads 79 are illustrated in this embodiment mounted in a locked position on an adjustable plate assembly 189. Footpads 79 are similar in construction to footpad 79 of FIG. 5; hence they retain the same element number here.

Plate assembly 189 is an intermediary base that bolts on to a wheeled carriage such as carriage 33 of FIG. 4. Plate 189 has two opposite facing edges that provide guide channels 193 and 194 for movable suspended footpad assemblies. Channel 193 on one side is best illustrated in FIG. 12. Channel 193 is adapted to house a slotted cam-rod 191, which is adapted to lock the movable footpad assemblies in place.

Cam-rod 191 has a plurality of slots 192 arranged in equally spaced and collinear fashion, and presented over the entire length of channel 193 along one side of the plate assembly. The purpose of slots 192 is to engage a plurality of equally spaced teeth provided on one edge each of two toothed base-plates (not shown here but illustrated below), one each affixed to the bottoms of footpad assemblies 79.

A spring-loaded lever 197 is provided on one end of cam-rod 191 and is adapted to cause rotation of cam-rod 191 within channel 193 enabling slots 192 to be presented inward as shown or rotated back into channel 193 as directed by a user. Spring lever 197 in this embodiment fastens to channel 193 such that a wound spring engages a fixed location in the channel while the opposite end of the spring is retained by lever 197 creating a spring tension. There are several ways known in the art for a spring lever to be mounted such that a shaft or other part is put under spring tension. The spring-loaded arrangement provides for the cam rod to be always urged into the locked position for the footpad assemblies, so these assemblies may only be moved to adjust center distance under positive direction of the user.

By manually rotating spring lever 197 a user can unlock the footpad assemblies and manually move each to a new position as desired. In this way, footpads may be slidably inserted from either end of adjuster-plate 189, as indicated by directional arrows, and adjusted to any desired spacing related to center distance. When desired positions are attained, letting go of spring lever 197 locks the footpads in place on plate assembly 189. In one embodiment, a safety lock is provided to give added assurance that the footpad assemblies will stay in position during operation. Channel 194 on the opposite side is adapted to house non-toothed edges of the aforementioned toothed base-plates.

Figure 13A:
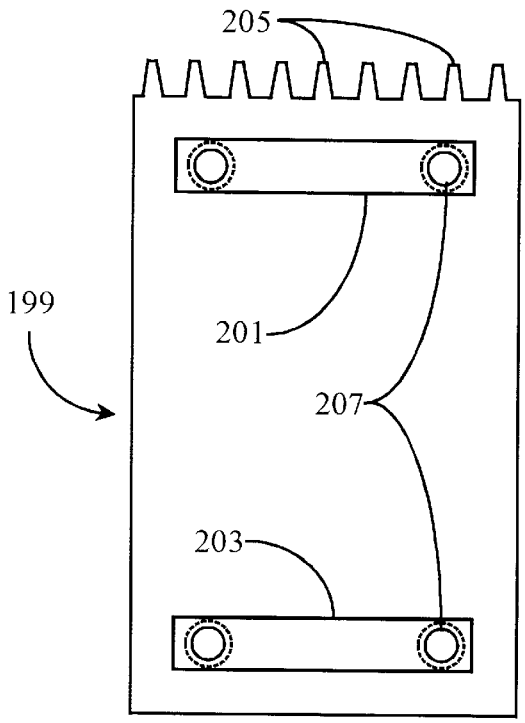
FIG. 13A is a plan view and FIG. 13B is a side view of a slotted base-plate according to an embodiment of the present invention.
Figure 13B:
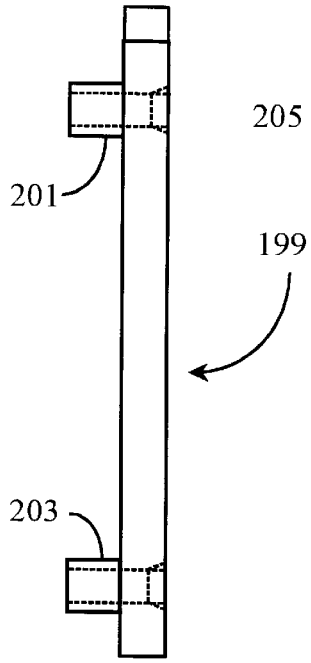

FIG. 13A is a plan view of a toothed base-plate 199 according to an embodiment of the present invention, and FIG. 13B is a side view of the base plate of FIG. 13A. As previously described, footpads 79 of FIG. 12 each have a toothed base-plate 199 installed on the bottom surfaces of associated footpad assemblies 79 (FIG. 12). Each base-plate 199 has a row of equally spaced teeth 205 presented along one edge for the purpose of engaging slots 192 of FIG. 12 in cam 191. In this embodiment, base-plate 199 has two spacer bars 201 and 203 adapted to space it from the underside of the outer frame member of a footpad assembly when mounted.

Bars 201 and 203 are, in this example, formed of one piece with base-plate 199, however, in other embodiments, they may be separate mounted structures. There are four threaded holes 207 (two for each spacer bar) provided through base-plate 199 and spacer bars 201, and 203 for mounting purposes. Machine screws or the like may be used for mounting plate 199 to the outer frame member of each footpad assembly. As seen in FIG. 13B, bolt holes 207 are chamfered on the side making contact with carriage assembly 33 such that they lay flat and may slide without scratching or marring the surface.

Figure 13C:
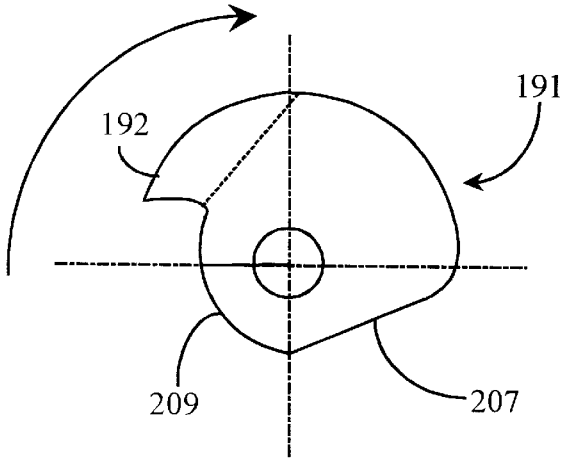
FIG. 13C is an end-view of the slotted cam-rod of FIG. 12.

FIG. 13C is an end-view of the slotted cam-rod 191 of FIG. 12 in this embodiment. Cam-rod 191 has a slotted portion 192 as previously described, a radiused back-grind 209, and a flat portion 207. As slots 192 are rotated in the direction of the arrow, engaging teeth 205 on base-plate 199 of FIG. 13A are released at the beginning point of back-grind 209. As flat 207 rotates so as to face teeth 205, a small amount of space is created between the top land portions of teeth 205 and the surface of flat 207 enabling footpad assemblies such as footpads 79 to be moved to a different position or removed altogether.

It will be apparent to one with skill in the art that there may be more than one general configuration of slots and teeth than is illustrated here without departing from the spirit and scope of the present invention. For example, a base-plate such as plate 199 may be slotted while a cam-rod such as rod 191 is toothed. There may be more or fewer slots and teeth presented, and so on. In an alternate embodiment, footpad assemblies may be lowered in from the top with teeth and slots remaining in a rigid configuration on both sides of a base-plate and on opposite facing structures mounted to an adjuster-plate wide enough to support this type of fitting. Clamps could be used to secure the footpad assemblies after lowering them into place.

In another embodiment of the present invention an alternative adjustment mechanism for footpads may be used comprising one or more spring-loaded pop-up detents. A first footpad assembly may be mounted to the plate assembly separately, allowing for individual adjustment, or with a second footpad as an assembly. A pop-up detent can be mounted on an edge of a footpad assembly in a position so that when a user manually pulls back and then releases a spring-loaded pin within the detent assembly, the pin slides in and out of a slot or hole on the face or edge of the plate assembly, the pin and slot or hole being in-line when the desired footpad position is attained. The plate assembly can have a plurality of such slots or holes arranged in equally spaced and collinear fashion. A spring-loaded detent assembly could comprise a cylindrically shaped casing open on the end facing the hole or slot and containing a pin that slides in and out in both directions. A protrusion or attachment to the pin serves as a handle enabling a user to manually pull the pin back within the casing. Within the casing and located behind the pin a spring of roughly the same diameter of the pin provides outward tension to the pin when a user manually pulls it back using the handle. When a user manually releases the pin in the mounted detent assembly the spring tension behind the pin pushes the pin into the aligned slot or hole and locks the footpad assembly into the desired position. Once locked into the desired position by the pin assembly, the footpad assembly may be otherwise mainly secured to the plate assembly by utilizing many different methods. By again pulling back the pin a user can unlock the footpad assembly and adjust to another position as desired. This manner of spring-loaded pin arrangement within the detent assembly provides for the locking pin to be always urged into the outer or locked position. In addition to the footpad adjustment functionality of the pop-up detent assembly, in various alternative embodiments the detent assembly may have more or less of an integral role of securing the footpad assembly to the plate assembly.

It will be apparent to the skilled artisan that there are alternative arrangements and mechanisms that might be used to allow the footpads to be spaced and secured with the new spacing. The mechanisms described above are but a few of the possibilities. There are many others. For example, an intermediate plate assembly could be provided wherein there are two plates with one telescoping into the other, and having a locking apparatus to fix the relative positions when the desired separation is achieved. In this embodiment one footpad would be mounted to one of the telescoping plates and the other footpad to the other.

Figure 14:
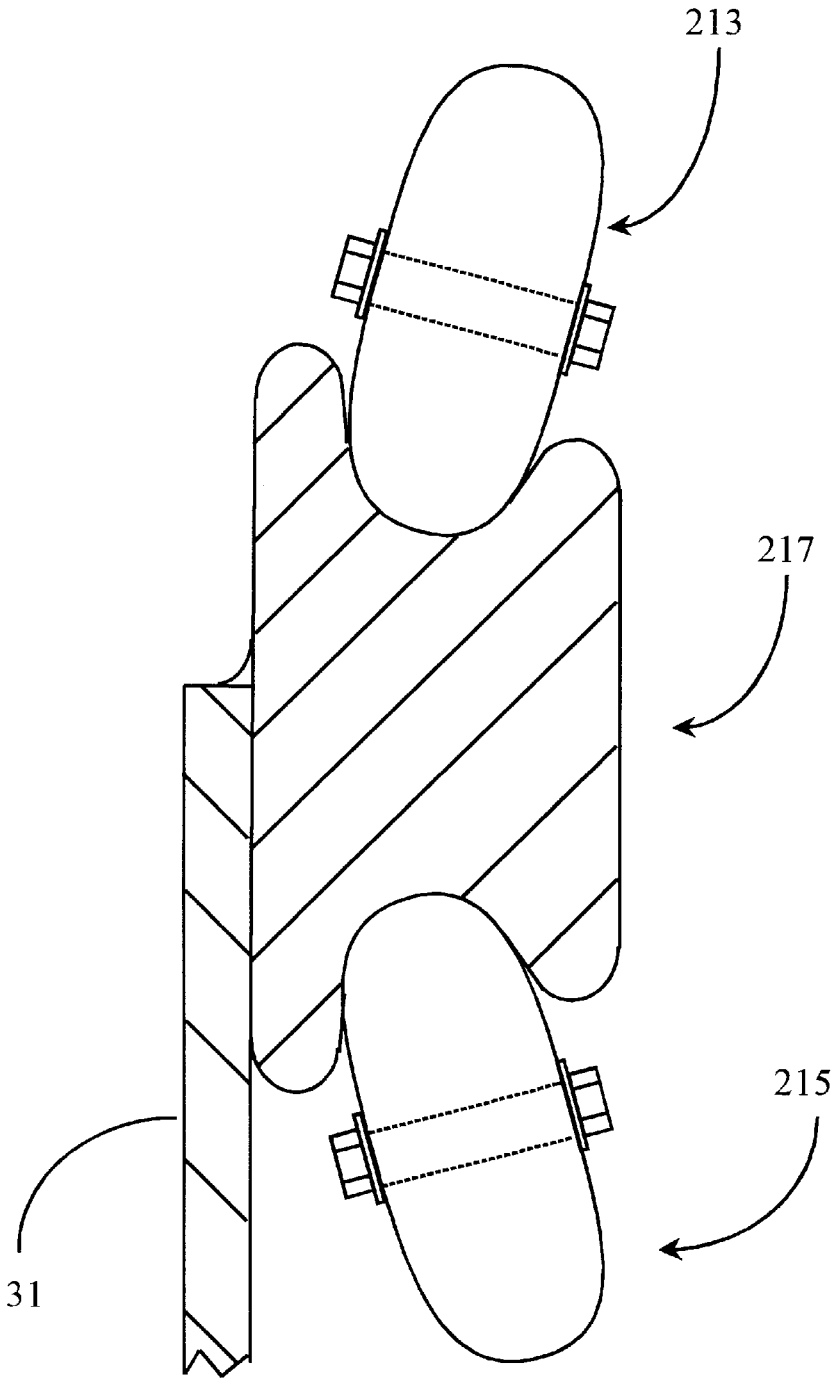
FIG. 14 is a cross-sectional view of a main wheel, a keeper wheel, and a semi-arcuate rail according to an alternate embodiment of the present invention.

FIG. 14 is a cross-sectional view of a semi-arcuate rail 217 with a main wheel 213, and a keeper wheel 215 in position according to an alternate embodiment of the present invention. As previously described in FIG. 1 above, semi-arcuate rails, shown round in FIG. 1 and other FIGS. in embodiments described above, may also be extruded to provide opposite channels for wheels, and then die-formed to obtain a desired semi-arcuate shape. This embodiment is especially useful for applications having footpads or platforms of exceptionally large dimensional features (length and width) than standard assemblies. Keeper-wheels such as wheels 215 and wheels 71 and 69 of FIG. 4 provided added restraint in order to prevent an assembly from tipping or otherwise being lifted from rails during operation.

Rail 217 is shown welded in this illustration to frame member 31, and in embodiments of the overall apparatus using such extruded rails, the rails would also be welded to end rails 27 as described previously for rails 22. Wheels 213 and 215 are not shown as assembled to a wheeled carriage in this illustration, but would in practice be mounted to such carriages in much the same manner as already described for wheels used with round rails.

Figure 15:
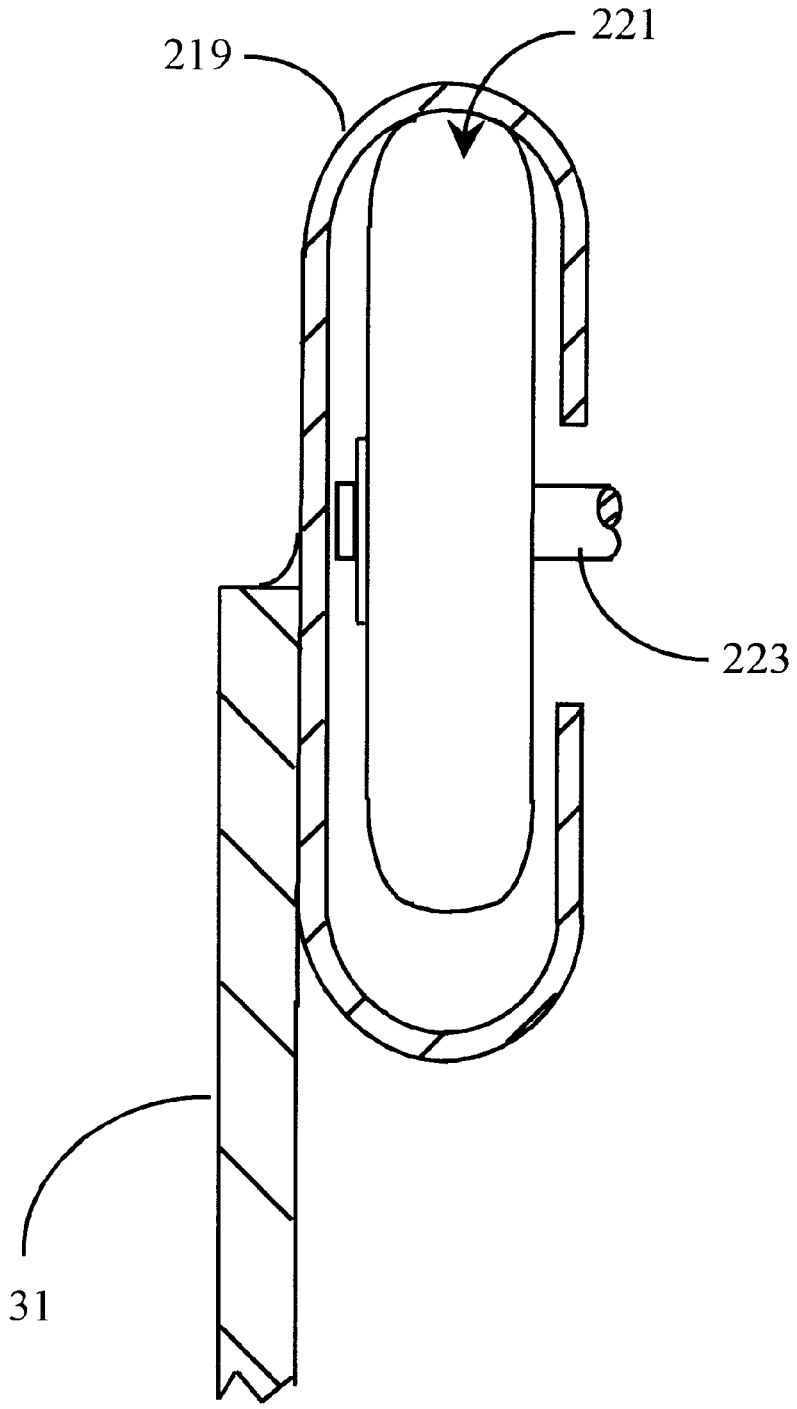
FIG. 15 is a cross section of an integral captive rail and wheel arrangement in an embodiment of the present invention.

FIG. 15 is a cross-section view through a rail 219 in yet another embodiment of the invention, showing a wheel assembly 221 having a shaft 223, with the wheel engaged in rail 219. In this embodiment rails 219 replace rails 22 or 217 shown in other embodiments, and are formed in an arc or an arc with straight-leg portions as taught elsewhere in this disclosure. Rails 219 may be extruded from suitable material, or may be formed by bending a plate and then forming the necessary arc using a die or other suitable tool. In preferred embodiments rails 219 are welded to structure 31 as shown, and also to end rails 27 (not shown).

In this embodiment Wheels 221 are mounted to a wheeled carriage by shafts 223 in various positions to support the carriage in its to-and-fro movements on (in) rails 219. Some wheels are mounted to contact the upper portion of rails 219 as shown in FIG. 15, and others are mounted to contact the lower portion of rails 219, thus accomplishing the functions of the wheeled carriage taught with reference to FIG. 4 having keeper wheels. It will be apparent to the skilled artisan that there are a variety of positions wheels may be mounted to accomplish the purpose.

Figure 16:
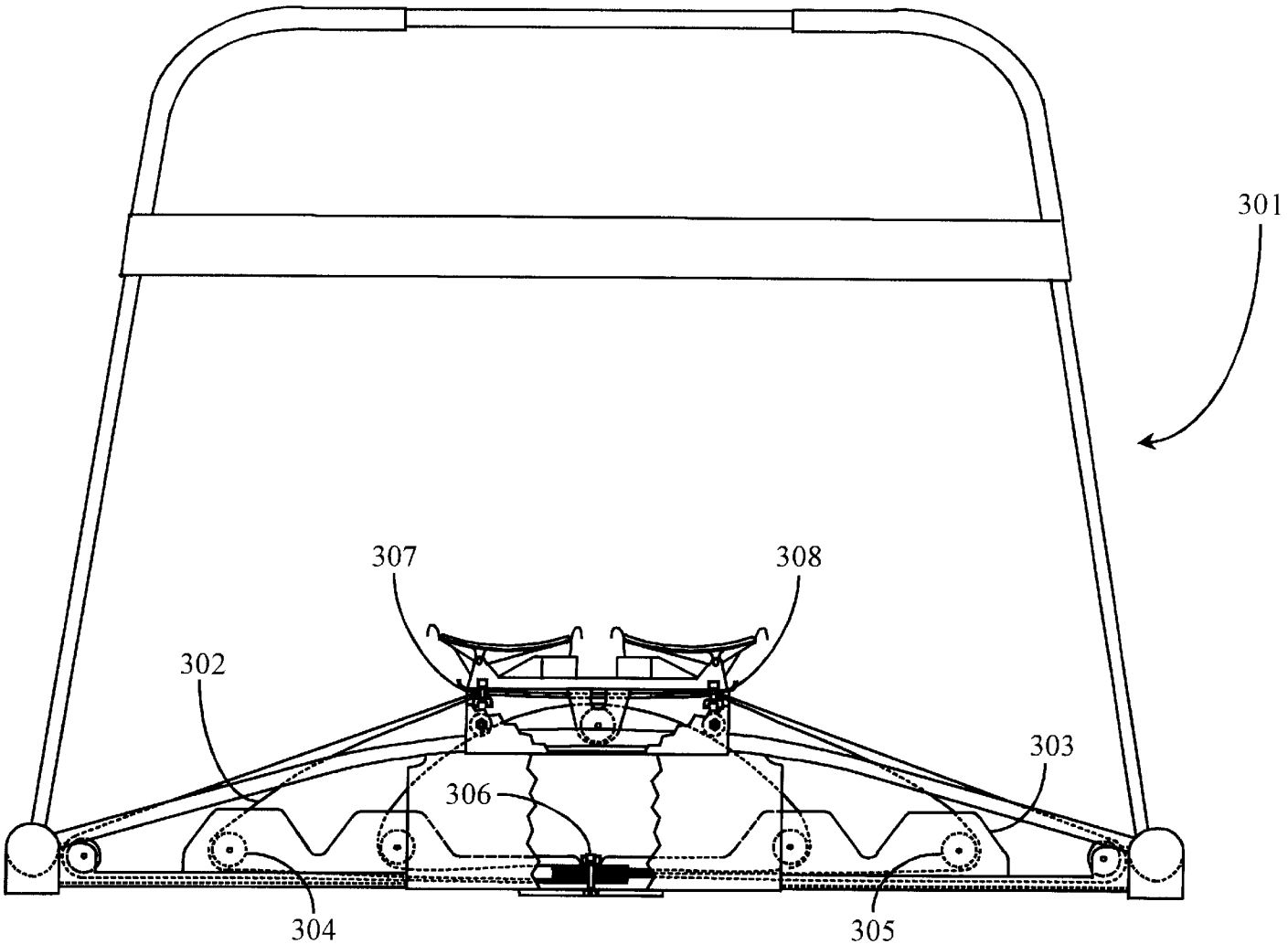
FIG. 16 is an elevation view of a ski-exercising device illustrating an optional third power band according to another embodiment of the present invention.

FIG. 16 is an elevation view of a ski-exercising apparatus 301 according to an embodiment of the invention illustrating an optional third power band. Apparatus 301 is provided having elements similar to those of exercisers previously described herein except for novel improvements described below. For this reason only the improvements are described. To better illustrate elements within, additional roller-mount openings similar to those of tensioning structure 25 of FIG. 1A are not shown but may be assumed to be present, and cut-away views are shown of the wheeled carriage and support member.

Apparatus 301 provides a third power band 302 assembled between the first, or outer, power band and the second, or inner, power band. In this embodiment the free ends of third power band 302 are illustrated as fastened at clamp 306, having one end clamped between the free ends of the outer band and the other end in between the ends of the outer and inner bands. It will be apparent that the clamping locations of power bands and positions of clamped free ends may vary. A tensioning structure 303 is provided, illustrated as a modification to a tensioning structure such as that of FIG. 1A, having a longer length and properties to support a third power band and hardware. Tensioning structure 303 is welded in this embodiment to the bottom surface of the central frame structure similarly to embodiments previously described. Rollers 304 and 305 are rotatably mounted to the outer positions of tensioning structure 303 providing support to third power band 302, third power band 302 extending from clamp 306 passing under the inner rollers mounted between rollers 304 and 305 and passing under and over rollers 304 and 305 back toward center, over a third roller rotatably mounted under the wheeled carriage and fastened with the outer power band to the underside of the wheeled carriage by clamps 307 and 308.

It will be apparent to one with skill in the art that the many improvements to existing ski-exercising equipment described as separate embodiments herein add durability, safety, improved operating characteristics, manufacturability, and convenience over apparatus of the prior art. The improvements also enable implementation of new apparatus such as the previously described snowboard application of FIGS. 9A and 9B, and the Double Diamond application (double-suspended Footpads) application of FIG. 12. Moreover, future applications may now be implemented by developing new upper platform assemblies, and still be integrated easily with the improved rail and carriage apparatus as taught herein. Therefore, the present invention should be afforded the broadest scope possible. The spirit and scope of the present invention is limited only by the claims that follow.

What is claimed is:

1. A ski exercising machine, comprising:

a frame structure having a first end and a second end;

a set of two parallel rails forming an arcuate rail set, each rail mounted to the frame structure at each end;

a wheeled carriage riding on the rails;

a removable tray mounted to the wheeled carriage;

a set of two articulated footpad assemblies, each mounted to the removable tray; and a first power band having two ends, each end clamped to a bottom surface of the frame structure beneath the wheeled carriage, passing over first rollers fixed to the frame structure, and anchored to the wheeled carriage, such that the power band is extended and exerts a restraining force toward the center of the machine as the wheeled carriage translates on the rails to either side of center;

characterized in that the set of rails have a central arcuate portion rising to a maximum height at the center, and straight portions extending from each frame end to the central arcuate portion, and further characterized in that the two articulated footpad assemblies each comprise a foot contact area having front and back upward extensions pivotally joined to frame elements above the footpad area, forming swing-cradle footpads.

2. The machine of claim 1 wherein the frame ends are spaced apart more than 48 inches, and the arcuate portion of the rail set extends for at least one third of the overall length.

3. The machine of claim 1 wherein transverse frame members are welded at each of the frame structure ends to the rails and the rails are welded to the frame structure, and wherein the bottom surface of the central frame structure is joined by welding to the transverse frame members on each end by power band guides, the power band guides, the transverse frame members, and the bottom surface of the frame structure all lying parallel to and adjacent the horizontal surface.

4. The machine of claim 1 wherein the two swing-cradle footpad assemblies each mount slidably by an interface to the removable tray, the interface including a lock-unlock mechanism whereby the footpad assemblies may be unlocked, adjusted in position on the upper tray, and relocked, so the center distance between the footpads may be readily adjusted.

5. The machine of claim 1 wherein the footpads have a home position wherein the footpads are each canted inward, the degree of cant determined by the length of the link.

6. The machine of claim 1 wherein the rails are extruded each having a groove in an upward facing surface, and the wheeled carriage includes wheels that ride within the groove in the upward-facing surface.

7. The machine of claim 6 further comprising a groove in a downward-facing surface of each rail, and wherein the wheeled carriage includes wheels engaging both the upward-facing and downward-facing grooves.

8. The machine of claim 1 wherein each rail has a "C" cross-section comprising internally an upper, downward-facing track and a lower, upward-facing track, and wherein the wheeled carriage has two or more wheels guiding on the upper track and two or more wheels guiding on the lower track.

9. A ski exercising machine, comprising:

a frame structure having a first end and a second end;

a set of two parallel rails forming an arcuate rail set, each rail mounted to the frame structure at each end;

a wheeled carriage riding on the rails;

a removable tray mounted to the wheeled carriage;

a set of two articulated footpad assemblies, each mounted to the removable tray; and a first power band having two ends, each end clamped to a bottom surface of the frame structure beneath the wheeled carriage, passing over first rollers fixed to the frame structure, and anchored to the wheeled carriage, such that the power band is extended and exerts a restraining force toward the center of the machine as the wheeled carriage translates on the rails to either side of center;

characterized in that the first power band is clamped to the undersurface of the wheeled carriage at two positions, one each at each end of the wheeled carriage, such that the first power band lies flat along the width of the wheeled carriage under the wheeled carriage, and further characterized in that the first rollers are positioned such that the first power band clamped at the ends to the bottom surface of the frame structure lies in the power band guides to each side of the frame structure, passing under and over the rollers to the wheeled carriage, the power band guides acting as protective members preventing the first power band from contacting the horizontal support surface.

10. The machine of claim 9 wherein the frame ends are spaced apart more than 48 inches, and the arcuate portion of the rail set extends for at least one third of the overall length.

11. The machine of claim 9 wherein transverse frame members are welded at each of the frame structure ends to the rails and the rails are welded to the frame structure, and wherein the bottom surface of the frame structure is joined by welding to the transverse frame members on each end by power band guides, the power band guides, the transverse frame members, and the bottom surface of the frame structure all lying parallel to and adjacent the horizontal surface.

12. The machine of claim 9 wherein the footpads have a home position wherein the footpads are each canted inward, the degree of cant determined by the length of the link.

13. The machine of claim 9 wherein the rails are extruded each having a groove in an upward facing surface, and the wheeled carriage includes wheels that ride within the groove in the upward-facing surface.

14. The machine of claim 13 further comprising a groove in a downward-facing surface of each rail, and wherein the wheeled carriage includes wheels engaging both the upward-facing and downward-facing grooves.

15. The machine of claim 9 wherein each rail has a "C" cross-section comprising internally an upper, downward-facing track and a lower, upward-facing track, and wherein the wheeled carriage has two or more wheels guiding on the upper track and two or more wheels guiding on the lower track.

16. A ski exercising machine, comprising:

a frame structure having a first end and a second end;

a set of two parallel rails forming an arcuate rail set, each rail mounted to the frame structure at each end;

a wheeled carriage riding on the rails;

a removable tray mounted to the wheeled carriage;

a set of two articulated footpad assemblies, each mounted to the removable tray;

a first power band having two ends, each end clamped to a bottom surface of the frame structure beneath the wheeled carriage, passing over first rollers fixed to the frame structure, and anchored to the wheeled carriage, such that the power band is extended and exerts a restraining force toward the center of the machine as the wheeled carriage translates on the rails to either side of center; and a second power band within the first power band, the second power band having two ends both clamped to the bottom surface of the frame structure along with the ends of the first power band, above the ends of the first power band, the second power band extending to second rollers rotatably mounted to the bottom surface of the frame structure, the second power band passing under and over the second rollers back toward center, and over a third roller rotatably mounted under the wheeled carriage, characterized in that the set of rails have a central arcuate portion rising to a maximum height at the center, and straight portions extending from each frame end to the central arcuate portion.

17. The machine of claim 16 wherein the frame ends are spaced apart more than 48 inches, and the arcuate portion of the rail set extends for at least one third of the overall length.

18. The machine of claim 16 wherein transverse frame members are welded at each of the frame structure ends to the rails and the rails are welded to the frame structure, and wherein the bottom surface of the central frame structure is joined by welding to the transverse frame members on each end by power band guides, the power band guides, the transverse frame members, and the bottom surface of the frame structure all lying parallel to and adjacent the horizontal surface.

19. The machine of claim 16 wherein the third roller is mounted spaced apart from the first power band clamped to the undersurface of the wheeled carriage by about the thickness of the two power bands, such that the second power band passing over the roller lightly contacts both the roller and the first power band.

20. The machine of claim 16 wherein the two footpad assemblies each mount slidably by an interface to the removable tray, the interface including a lock-unlock mechanism whereby the footpad assemblies may be unlocked, adjusted in position on the upper tray, and relocked, so the center distance between the footpads may be readily adjusted.

21. The machine of claim 16 wherein the footpads have a home position wherein the footpads are each canted inward, the degree of cant determined by the length of the link.

22. The machine of claim 1 wherein the rails are extruded each having a groove in an upward facing surface, and the wheeled carriage includes wheels that ride within the groove in the upward-facing surface.

23. The machine of claim 22 further comprising a groove in a downward-facing surface of each rail, and wherein the wheeled carriage includes wheels engaging both the upward-facing and downward-facing grooves.

24. The machine of claim 16 wherein each rail has a "C" cross-section comprising internally an upper, downward-facing track and a lower, upward-facing track, and wherein the wheeled carriage has two or more wheels guiding on the upper track and two or more wheels guiding on the lower track.

25. A ski exercising machine, comprising:

a frame structure having a first end and a second end;

a set of two parallel rails forming an arcuate rail set, each rail mounted to the frame structure at each end;

a wheeled carriage riding on the rails;

a removable tray mounted to the wheeled carriage;

a set of two articulated footpad assemblies, each mounted to the removable tray; and a first power band having two ends, each end clamped to a bottom surface of the frame structure beneath the wheeled carriage, passing over first rollers fixed to the frame structure, and anchored to the wheeled carriage, such that the power band is extended and exerts a restraining force toward the center of the machine as the wheeled carriage translates on the rails to either side of center;

characterized in that the set of rails have a central arcuate portion rising to a maximum height at the center, and straight portions extending from each frame end to the central arcuate portion, and further characterized that the two articulated footpads each have a contact surface for a user's foot and pivoted to rotate about an axis orthogonal to the direction of the rails, the axis below the level of the contact surface, and are joined by at least one link, such that the footpads are constrained to rotate together about their respective axes, and further characterized that the link is adjustable, such that the degree of cant at the home position may be adjusted.

26. The machine of claim 25 wherein the frame ends are spaced apart more than 48 inches, and the arcuate portion of the rail set extends for at least one third of the overall length.

27. The machine of claim 25 wherein transverse frame members are welded at each of the frame structure ends to the rails and the rails are welded to the frame structure, and wherein the bottom surface of the frame structure is joined by welding to the transverse frame members on each end by power band guides, the power band guides, the transverse frame members, and the bottom surface of the frame structure all lying parallel to and adjacent the horizontal surface.

28. The machine of claim 25 wherein the two footpad assemblies each mount slidably by an interface to the removable tray, the interface including a lock-unlock mechanism whereby the footpad assemblies may be unlocked, adjusted in position on the upper tray, and relocked, so the center distance between the footpads may be readily adjusted.

29. The machine of claim 25 wherein the footpads have a home position wherein the footpads are each canted inward, the degree of cant determined by the length of the link.

30. The machine of claim 25 wherein the rails are extruded each having a groove in an upward facing surface, and the wheeled carriage includes wheels that ride within the groove in the upward-facing surface.

31. The machine of claim 30 further comprising a groove in a downward-facing surface of each rail, and wherein the wheeled carriage includes wheels engaging both the upward-facing and downward-facing grooves.

32. The machine of claim 25 wherein each rail has a "C" cross-section comprising internally an upper, downward-facing track and a lower, upward-facing track, and wherein the wheeled carriage has two or more wheels guiding on the upper track and two or more wheels guiding on the lower track.

33. A ski exercising machine, comprising:

a frame structure having a first end and a second end;

a set of two parallel rails forming an arcuate rail set, each rail mounted to the frame structure at each end;

a wheeled carriage riding on the rails;

a removable tray mounted to the wheeled carriage;

a snowboard footpad assembly simulating a snowboard mounted on an interchangeable upper tray assembly; and a first power band having two ends, each end clamped to a bottom surface of the frame structure beneath the wheeled carriage, passing over first rollers fixed to the frame structure, and anchored to the wheeled carriage, such that the power band is extended and exerts a restraining force toward the center of the machine as the wheeled carriage translates on the rails to either side of center;

characterized in that the set of rails have a central arcuate portion rising to a maximum height at the center, and straight portions extending from each frame end to the central arcuate portion, and further characterized in that the wheeled carriage has weight-bearing wheels positioned to ride on upper surfaces of the rails and keeper wheels opposite individual ones of the weight-bearing wheels, the keeper wheels contacting undersurfaces of the rails, such that the wheeled carriage so equipped is positively retained on the rails, and further characterized in that, and further characterized in that the snowboard footpad is rotatable about an axis orthogonal to the direction of the rails, and has a length in the direction of the axis significantly more than the width of the wheeled carriage riding on the rails, and extending beyond the wheeled carriage on both sides.

34. The machine of claim 33 wherein the frame ends are spaced apart more than 48 inches, and the arcuate portion of the rail set extends for at least one third of the overall length.

35. The machine of claim 33 wherein transverse frame members are welded at each of the frame structure ends to the rails and the rails are welded to the frame structure, and wherein the bottom surface of the central frame structure is joined by welding to the transverse frame members on each end by power band guides, the power band guides, the transverse frame members, and the bottom surface of the frame structure all lying parallel to and adjacent the horizontal surface.

36. The machine of claim 33 wherein the rails are extruded each having a groove in an upward facing surface, and the wheeled carriage includes wheels that ride within the groove in the upward-facing surface.

37. The machine of claim 33 further comprising a groove in a downward-facing surface of each rail, and wherein the wheeled carriage includes wheels engaging both the upward-facing and downward-facing grooves.

38. The machine of claim 33 wherein each rail has a "C" cross-section comprising internally an upper, downward-facing track and a lower, upward-facing track, and wherein the wheeled carriage has two or more wheels guiding on the upper track and two or more wheels guiding on the lower track.

* * * * *